US011530106B2

(12) United States Patent
Imoto

(10) Patent No.: US 11,530,106 B2
(45) Date of Patent: Dec. 20, 2022

(54) PAPER SHEET HANDLING MACHINE

(71) Applicant: Glory Ltd., Himeji (JP)

(72) Inventor: Takaaki Imoto, Hyogo (JP)

(73) Assignee: GLORY LTD., Himeji (JP)

( * ) Notice: Subject to any disclaimer, the term of this patent is extended or adjusted under 35 U.S.C. 154(b) by 37 days.

(21) Appl. No.: 17/129,937

(22) Filed: Dec. 22, 2020

(65) Prior Publication Data

US 2021/0198072 A1 Jul. 1, 2021

(30) Foreign Application Priority Data

Dec. 27, 2019 (JP) ..... JP2019-237610

(51) Int. Cl.
*B65H 29/62* (2006.01)
*B65H 29/12* (2006.01)
(Continued)

(52) U.S. Cl.
CPC ..... *B65H 29/62* (2013.01); *B65H 5/062* (2013.01); *B65H 29/125* (2013.01); *G07D 11/10* (2019.01); *G07D 11/26* (2019.01); *G07D 11/40* (2019.01); *B65H 2301/314* (2013.01); *B65H 2301/3122* (2013.01); *B65H 2301/33214* (2013.01); *B65H 2301/42132* (2013.01); *B65H 2402/441* (2013.01); *B65H 2402/45* (2013.01); *B65H 2404/1521* (2013.01); *B65H 2404/611* (2013.01); *B65H 2404/63* (2013.01);
(Continued)

(58) Field of Classification Search
CPC ..... B65H 2404/1521; B65H 2601/11; B65H 2601/324; B65H 2402/441; B65H 2402/45; B65H 29/62; B65H 2301/314; B65H 2301/33214; B65H 2301/42132; B65H 2701/1912
See application file for complete search history.

(56) References Cited

U.S. PATENT DOCUMENTS 5,299,672 A 4/1994 Nishiumi et al.
7,500,667 B2 * 3/2009 Miyazaki ..... B42C 1/12 271/189
(Continued)

FOREIGN PATENT DOCUMENTS

JP 4-308992 A 10/1992
JP 2005-114979 A 4/2005
JP 2009-057157 A 3/2009

OTHER PUBLICATIONS

Extended European search report dated May 26, 2021, in corresponding European patent Application No. 20216446.3, 9 pages.

*Primary Examiner* — Jeremy R Severson
(74) *Attorney, Agent, or Firm* — Xsensus LLP

(57) ABSTRACT

A first transport path is put into a first state capable of transporting a paper sheet when a first portion and a second portion engage with each other, and put into a second state in which the second portion is swingable with respect to the first portion about a first swing axis extending in a direction orthogonal to a first direction and horizontal when engagement between the first portion and the second portion is released. A contact portion comes into contact with the second portion, thereby engaging the second portion with the first portion when a second unit in which the first transport path is in the second state is moved in a second direction opposite to the first direction.

18 Claims, 12 Drawing Sheets

(51) Int. Cl.

| | |
|---|---|
| ***B65H 5/06*** | (2006.01) |
| ***G07D 11/10*** | (2019.01) |
| ***G07D 11/26*** | (2019.01) |
| ***G07D 11/40*** | (2019.01) |

(52) U.S. Cl.
CPC .... *B65H 2601/11* (2013.01); *B65H 2601/321* (2013.01); *B65H 2601/324* (2013.01); *B65H 2701/1912* (2013.01)

(56) References Cited

U.S. PATENT DOCUMENTS

| | | | | |
|---|---|---|---|---|
| 8,083,230 | B2 * | 12/2011 | Spence | B65H 29/125 271/273 |
| 8,200,141 | B2 | 6/2012 | Matsushima et al. | |
| 8,419,006 | B2 * | 4/2013 | Imura | H04N 1/00543 399/125 |
| 9,493,318 | B2 * | 11/2016 | Kawamata | B65H 7/20 |
| 10,124,973 | B2 * | 11/2018 | Hari | B65H 5/062 |

* cited by examiner

PAPER SHEET HANDLING MACHINE

CROSS-REFERENCE TO RELATED APPLICATION

This application claims priority to Japanese Patent Application No. 2019-237610 filed on Dec. 27, 2019, the entire disclosure of which is incorporated by reference herein.

BACKGROUND

The technology herein disclosed relates to a paper sheet handling machine.

Japanese Unexamined Patent Publication No. H04-308992 discloses a coin handling unit. This coin handling machine is provided with a coin horizontal transport means, a coin horizontal transport means mount detect means, a shutter, a shutter drive means, and a shutter control means. The coin horizontal transport means is slidably arranged with respect to a machine main body, and forcibly transports an inserted coin in a horizontal direction by rotationally driving an endless belt. The coin horizontal transport means mount detect means detects that the coin horizontal transport means is mounted in a normal position. The shutter opens and closes a coin inlet. The shutter drive means drives the shutter. The shutter control means enables drive of the shutter drive means on condition that there is a detection output of the coin horizontal transport means mount detect means.

SUMMARY

In the unit disclosed in Japanese Unexamined Patent Publication No. H04-308992, the coin horizontal transport means is pulled out so as to be exposed out of the unit at the time of maintenance check and the like. Even if the coin horizontal transport means pulled out of the unit is mounted in the normal position after the maintenance check and the like, if components of the coin horizontal transport means are not returned to a state capable of transporting the coin, the coin cannot be transported normally. Note that, the same applies not only to the coin handling unit but also to the paper sheet handling machine that handles a paper sheet such as a banknote.

Therefore, it is an object of the technology herein disclosed to provide a paper sheet handling machine capable of reliably returning a transport path pulled out of the unit to a state capable of transporting.

The technology herein disclosed relates to a paper sheet handling machine including: a first unit; and a second unit including a first transport path that transports a paper sheet and movable in a first direction with respect to the first unit. The first transport path includes a first portion extending in the first direction, and a second portion engageable with the first portion. The first transport path is put into a first state in which the paper sheet between the first portion and the second portion is transportable when the first portion and the second portion engage with each other. The first transport path is put into a second state in which the second portion is swingable with respect to the first portion about a first swing axis extending in a direction orthogonal to the first direction and horizontal when engagement between the first portion and the second portion is released. The first unit includes a contact portion that comes into contact with the second portion to engage the second portion with the first portion when the second unit in which the first transport path is in the second state is moved in a second direction opposite to the first direction.

In the above-described configuration, the second unit can be moved in the first direction with respect to the first unit to switch the first transport path of the second unit from the first state to the second state. Thereafter, even when the second unit is moved in the second direction without returning the first transport path from the second state to the first state in which the paper sheet is transportable, it is possible to bring the contact portion into contact with the second portion of the second unit, thereby engaging the second portion with the first portion to return the first transport path from the second state to the first state. As a result, the first transport path of the second unit can be reliably returned to the first state.

In the paper sheet handling machine, the first unit may include a facing surface that faces the second unit when the second unit in which the first transport path is in the second state is moved in the second direction and a raised portion provided on the facing surface. The contact portion may include the raised portion. The raised portion may be configured to come into contact with the second portion of the second unit to engage the second portion with the first portion when the second unit in which the first transport path is in the second state is moved in the second direction.

In the above-described configuration, by bringing the raised portion into contact with the second portion of the second unit that moves in the second direction, it is possible to engage the second portion with the first portion to return the first transport path from the second state to the first state. As a result, the first transport path of the second unit can be reliably returned to the first state.

In the paper sheet handling machine, the facing surface may be a flat surface. In the raised portion, at least a portion brought into contact with the second portion may be formed into an arc shape.

In the above-described configuration, it is possible to reduce sliding resistance between the second portion of the second unit that moves in the second direction and the raised portion. As a result, the movement of the second unit in the second direction can be made smooth.

In the paper sheet handling machine, the raised portion may include a roller that rotates about a rotation axis extending in a direction orthogonal to the second direction and horizontal.

In the above-described configuration, the roller that comes into contact with the second portion of the second unit that moves in the second direction rotates, so that the movement of the second unit in the second direction can be made smooth.

In the paper sheet handling machine, the first unit may be provided with a biasing member that biases the raised portion when the second unit in which the first transport path is in the second state is moved in the second direction.

In the above-described configuration, a force with which the raised portion pushes the second portion toward the first portion can be increased. This allows the second portion to be easily engaged with the first portion.

In the paper sheet handling machine, the raised portion may include a plurality of projections. The plurality of projections may be arranged in a direction in which the first swing axis extends.

In the above-described configuration, the second portion can be pushed toward the first portion over a wide range in the direction in which the first swing axis extends. This allows the second portion to be easily engaged with the first portion.

In the paper sheet handling machine, a first engagement portion may be provided on a portion on the first direction side of the first portion. A second engagement portion that engages with the first engagement portion may be provided on a portion on the first direction side of the second portion.

In the above-described configuration, a pushing force necessary for engaging the second portion with the first portion can be reduced as compared with a case where the first and second engagement portions are provided on portions opposite to the first and second portions in the first direction. Note that the pushing force is a force with which the raised portion pushes the second portion toward the first portion. This allows the second portion to be easily engaged with the first portion.

In the paper sheet handling machine, a storage unit for storing the paper sheet may be provided inside the first unit. A door for exposing the inside of the first unit may be provided on an end on the first direction side of the first unit. The raised portion may be provided on a side closer to the door than the center of the first unit in the first direction.

In the above-described configuration, it is possible to shorten a distance from the end on the first direction side of the first unit to the raised portion as compared with a case where the raised portion is provided closer on a side opposite to the door than the center of the first unit in the first direction. As a result, the first unit can be made compact.

In the paper sheet handling machine, the contact portion may include a corner on the first direction side of the first unit. The corner on the first direction side of the first unit may be configured to guide the movement of the second portion to the first portion by coming into contact with the second portion of the second unit when the second unit in which the first transport path is in the second state is moved in the second direction.

In the above-described configuration, the movement of the second portion of the second unit that moves in the second direction to the first portion can be made smooth. This allows the second portion to be easily engaged with the first portion.

In the paper sheet handling machine, at least an outer frame of the second portion may be made of resin.

In the above-described configuration, an impact occurring by the contact between the second portion and the contact portion can be alleviated as compared with a case where the outer frame of the second portion is made of metal.

In the paper sheet handling machine, the second unit may include a second transport path that transports the paper sheet. The second transport path may be configured to include a third portion extending in the first direction and a fourth portion engageable with the third portion. The second transport path is put into a third state in which the paper sheet between the third portion and the fourth portion is transportable when the third portion and the fourth portion engage with each other. The second transport path is put into a fourth state in which the fourth portion is swingable with respect to the third portion about a second swing axis extending in a direction orthogonal to the first direction and horizontal when engagement between the third portion and the fourth portion is released.

In the above-described configuration, by putting the second transport path into the third state, the paper sheet can be normally transported in the second transport path. Furthermore, the second transport path can be opened by putting the second transport path into the fourth state. As a result, the second transport path can be checked.

DETAILED DESCRIPTION

Figure 1:
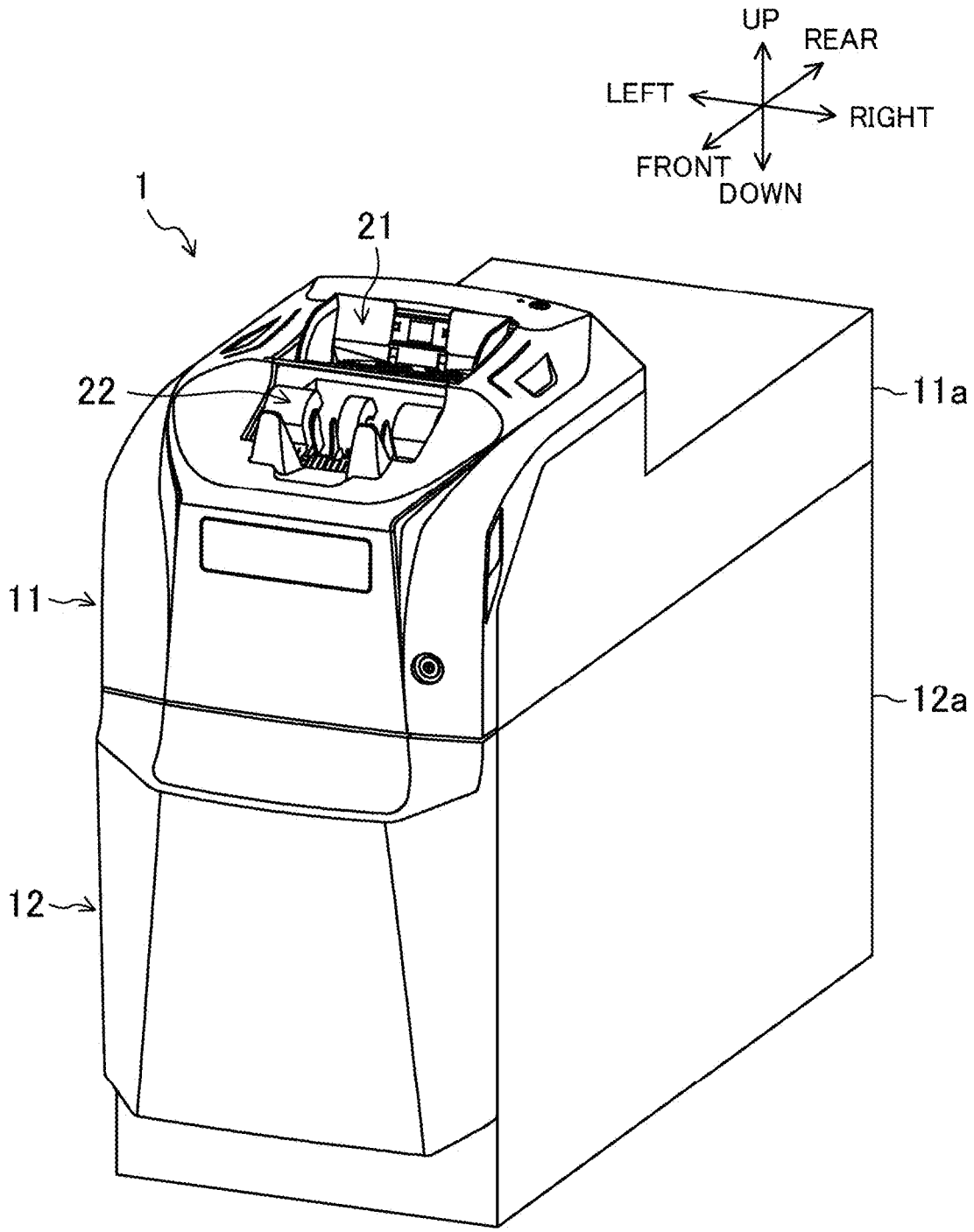
FIG. 1 is a perspective view illustrating an outer appearance of a paper sheet handling machine of an embodiment.

Hereinafter, an embodiment is described in detail with reference to the drawings. Note that the same or corresponding parts in the drawings are assigned with the same reference signs, and the description thereof is not repeated.

(Paper Sheet Handling Machine)

Figure 2:
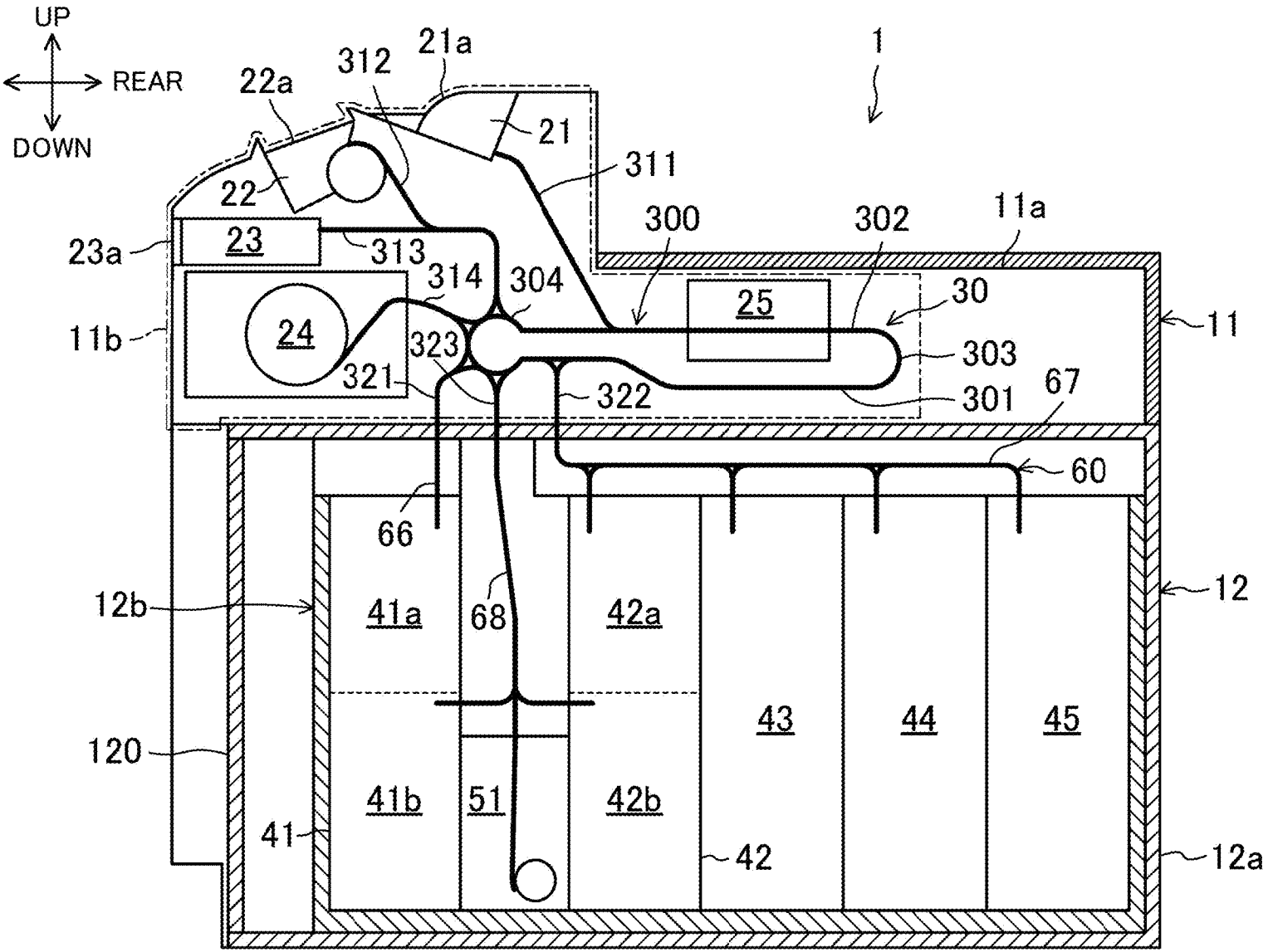
FIG. 2 is a schematic view illustrating a configuration of the paper sheet handling machine of the embodiment.
Figure 3:
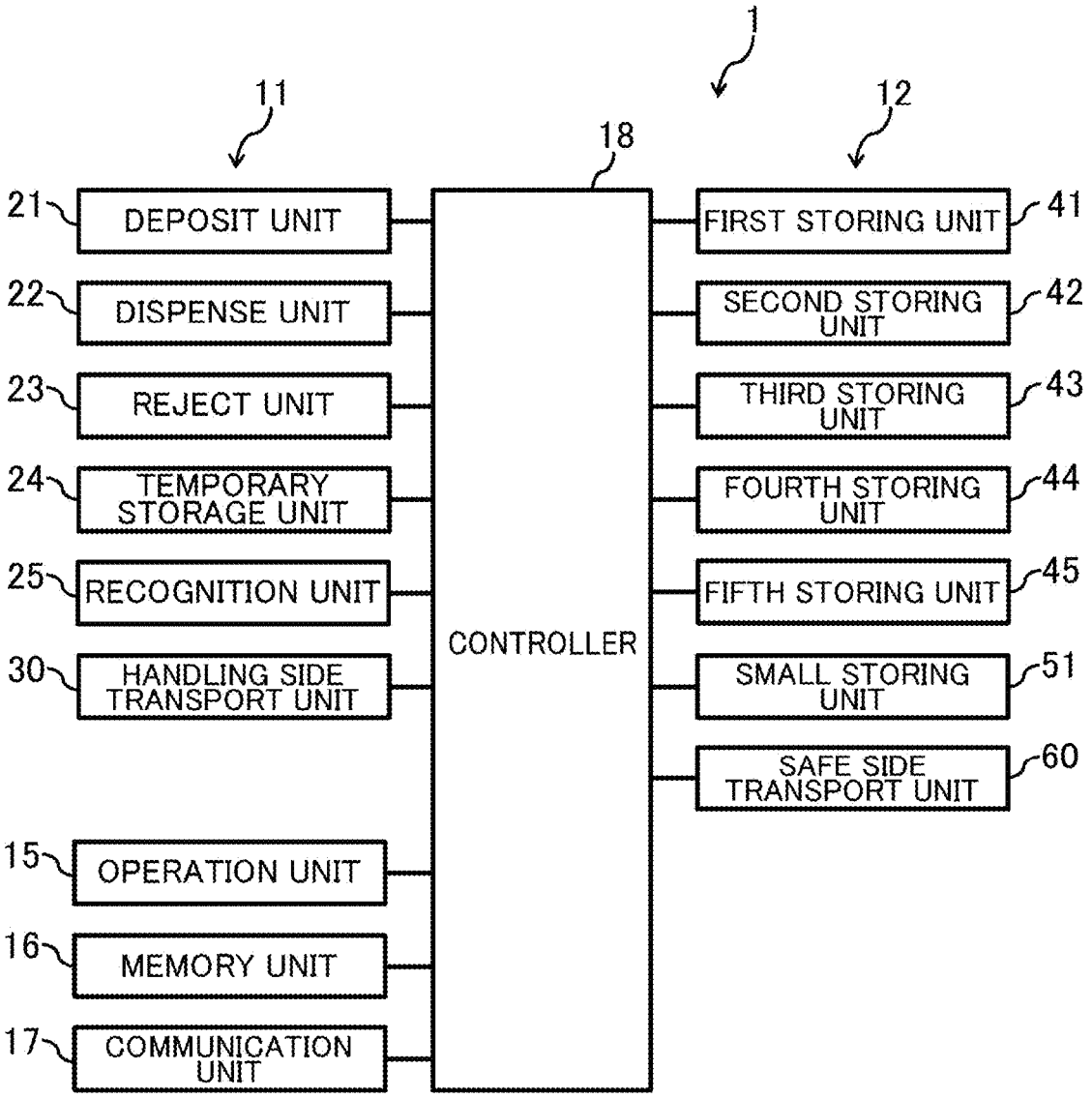
FIG. 3 is a block diagram illustrating the configuration of the paper sheet handling machine of the embodiment.

FIG. 1 illustrates an outer appearance of a paper sheet handling machine 1 of the embodiment, and FIGS. 2 and 3 illustrate a configuration of the paper sheet handling machine 1 of the embodiment. In this example, the paper sheet handling machine 1 is a banknote handling machine that handles loose banknotes being an example of the paper sheets and performs various types of handling including deposit handling and dispense handling. For example, the paper sheet handling machine 1 may be installed in a financial institution such as a bank, or may be installed in, e.g., a back-office of a retail store.

Note that directions (front-back, right-left, up-down) used in the following description correspond to the directions in a case where the paper sheet handling machine 1 installed on a horizontal plane is seen from the front. A front side of the paper sheet handling machine 1 is a side on which an inlet 21*a* of a deposit unit 21 and an outlet 22*a* of a dispense unit 22 to be described are formed, and a rear side of the paper sheet handling machine 1 is a side opposite to the side on which the inlet 21*a* of the deposit unit 21 and the outlet 22*a* of the dispense unit 22 are formed.

The paper sheet handling machine 1 is provided with a handling unit 11, a safe unit 12, an operation unit 15, a memory unit 16, a communication unit 17, and a controller 18. The handling unit 11 is provided above the safe unit 12.

[Handling Unit]

The handling unit 11 includes a handling housing 11*a* and a handling movable unit 11*b*. The handling housing 11*a* is formed into a rectangular parallelepiped box shape that extends in the front-rear direction and opens on the front side. The handling housing 11*a* accommodates the handling movable unit 11*b*. The handling movable unit 11*b* may be pulled out forward from the handling housing 11*a*. The handling movable unit 11*b* includes the deposit unit 21, the dispense unit 22, a reject unit 23, a temporary storage unit 24, a recognition unit 25, and a handling side transport unit 30.

<Deposit Unit>

The deposit unit 21 is an insertion unit into which a banknote is inserted. The deposit unit 21 is provided on a front portion of the handling movable unit 11*b*. The deposit unit 21 includes the inlet 21*a* that opens upward. An operator manually inserts the banknote into the deposit unit 21 via the inlet 21*a*. The deposit unit 21 may hold a plurality of banknotes in a stacked state. The deposit unit 21 is provided with a feed mechanism that feeds the banknotes inserted into the deposit unit 21 one by one to the handling side transport unit 30.

<Dispense Unit>

The dispense unit 22 is a dispense unit that dispenses the banknote. The dispense unit 22 is provided in front of the deposit unit 21 in the front portion of the handling movable unit 11*b*. The dispense unit 22 may hold a plurality of banknotes in a stacked state. The dispense unit 22 includes the outlet 22*a* that opens upward in front of the inlet 21*a*. The operator may manually take out the banknotes accumulated in the dispense unit 22 via the outlet 22*a*. Note that the dispense unit 22 may be provided with a shutter that opens and closes the outlet 22*a*.

<Reject Unit>

The reject unit 23 accumulates the banknotes to be rejected. The reject unit 23 is provided below the dispense unit 22 in the front portion of the handling movable unit 11*b*. The reject unit 23 may hold a plurality of banknotes in a stacked state. The reject unit 23 includes a reject opening 23*a* that opens forward. The reject unit 23 is provided with a shutter that opens and closes the reject opening 23*a*. When the shutter opens, the operator may manually take out the banknotes accumulated in the reject unit 23 via the reject opening 23*a*.

<Temporary Storage Unit>

The temporary storage unit 24 stores the banknote. Furthermore, the temporary storage unit 24 feeds the stored banknote. The temporary storage unit 24 is provided below the reject unit 23 in the front portion of the handling movable unit 11*b*. As the temporary storage unit 24, a known configuration of a storage unit that stores and feeds the banknote may be employed. In this example, the temporary storage unit 24 is a tape-type storage unit. The tape-type storage unit stores the banknote by winding the banknote around a drum together with a tape. Note that the temporary storage unit 24 may also be a stack-type storage unit. The stack-type storage unit stores the banknotes in a stacked manner.

<Recognition Unit>

The recognition unit 25 recognizes the banknote. Specifically, the recognition unit 25 is provided on the handling side transport unit 30 and performs recognition handling on the banknote transported by the handling side transport unit 30. In the recognition handling, the recognition unit 25 recognizes denomination, fitness, old and new, authenticity, and transport state of the banknote, a serial number put on the banknote and the like. For example, the recognition unit 25 is formed of various sensors such as a line sensor, a magnetic sensor, and an image sensor, a processor, a program for operating the processor, a memory for storing information and the like. The information obtained by the recognition unit 25 is transmitted to the controller 18.

<Handling Side Transport Unit>

The handling side transport unit 30 transports the banknote in the handling unit 11. Specifically, the handling side transport unit 30 transports the banknotes so that a plurality of banknotes is continuous at intervals in a transport direction. Furthermore, the handling side transport unit 30 transports the banknotes so that a long edge of the banknote is on a front side in the transport direction. Note that, the handling side transport unit 30 may also transport the banknotes so that a short edge of the banknote is on the front side in the transport direction.

The handling side transport unit 30 includes a transport path. The transport path of the handling side transport unit 30 is formed of, for example, a transport mechanism for transporting the banknotes such as a transport roller and a transport belt, a guide member that guides the transported banknotes, a diverter for switching the transport direction of the banknotes such as a diversion claw and the like. Furthermore, the handling side transport unit 30 includes a drive mechanism such as a motor and a gear. The drive mechanism drives the transport mechanism and the diverter of the transport path.

In this example, the transport path of the handling side transport unit 30 includes a ring road 300, first to fourth connection paths 311 to 314, and first to third communication paths 321 to 323. The ring road 300 is formed into a ring shape. One end of each of the first to fourth connection paths 311 to 314 is connected to the ring road 300. The other end of the first connection path 311 is connected to the deposit unit 21. The other end of the second connection path 312 is connected to the dispense unit 22. The other end of the third connection path 313 is connected to the reject unit 23. The other end of the fourth connection path 314 is connected to the temporary storage unit 24. One end of each of the first, second, and third communication paths 321, 322, and 323 is connected to the ring road 300. One end of the second communication path 322 is connected to the ring road 300. Connection of the other end of each of the first, second, and third communication paths 321, 322, and 323 is to be described later in detail.

[Safe Unit]

The safe unit 12 includes a safe housing 12*a* and a safe movable unit 12*b*. The safe housing 12*a* is formed into a rectangular parallelepiped box shape extending in the front-rear direction. A door 120 that may be opened and closed is provided on a front end of the safe housing 12*a*. The door 120 may be locked. For example, the door 120 is provided with an electronic lock. The safe housing 12*a* accommodates the safe movable unit 12*b*. A protection level of the safe housing 12*a* is higher than that of the handling housing 11*a*. Specifically, the safe housing 12*a* is formed of a metal plate having a thickness equal to or greater than a predetermined thickness. The safe movable unit 12*b* may be pulled out forward. Specifically, by opening the door 120 of the safe housing 12*a*, the operator may pull out the safe movable unit 12*b* forward from the safe housing 12*a*. The safe movable unit 12*b* includes first to fifth storing units 41 to 45, a small storing unit 51, and a safe side transport unit 60.

<Storing Unit>

Each of the first to fifth storing units 41 to 45 stores the banknote. Furthermore, each of the first to fifth storing units 41 to 45 feeds the stored banknote. The first to fifth storing units 41 to 45 are arranged in the front-rear direction. The first storing unit 41 includes a first upper storage unit 41*a* and a first lower storage unit 41*b*. Each of the first upper storage unit 41*a* and the first lower storage unit 41*b* stores and feeds the banknote. The second storing unit 42 faces the first storing unit 41 at an interval in the front-rear direction. The second storing unit 42 includes a second upper storage unit 42*a* and a second lower storage unit 42*b*. Each of the second upper storage unit 42*a* and the second lower storage unit 42*b* stores and feeds the banknote.

<Small Storing Unit>

The small storing unit 51 is arranged between the first storing unit 41 and the second storing unit 42. The small storing unit 51 stores the banknote. Furthermore, the small storing unit 51 feeds the stored banknote. A capacity of the small storing unit 51 is smaller than that of the first to fifth storing units 41 to 45. For example, the capacity of the small storing unit 51 may be about 100 sheets.

<Safe Side Transport Unit>

The safe side transport unit 60 transports the banknote in the safe unit 12. Specifically, the safe side transport unit 60 transports the banknotes so that a plurality of banknotes is continuous at intervals in a transport direction. Furthermore, the safe side transport unit 60 transports the banknote so that the long edge of the banknote is on a front side in the transport direction. Note that the safe side transport unit 60 may also transport the banknote so that the short edge of the banknote is on the front side in the transport direction.

The safe side transport unit 60 includes a transport path. The transport path of the safe side transport unit 60 is formed of, for example, a transport mechanism for transporting the banknote such as a transport roller and a transport belt, a guide member that guides the banknote to be transported, and a diverter for switching the transport direction of the banknote such as a diversion claw. Furthermore, the safe side transport unit 60 includes a drive mechanism such as a motor and a gear. The drive mechanism drives the transport mechanism and the diverter of the transport path.

In this example, the safe side transport unit 60 includes a first connection path 66, a second connection path 67, and a third connection path 68. Note that first to third through paths that penetrate in the up-down direction are provided on an upper wall of the safe housing 12*a*. The other ends of the first to third communication paths 321 to 323 of the handling side transport unit 30 are connected to the first to third through paths, respectively. The first to third connection paths 66 to 68 are connected to the first to third communication paths 321 to 323 via the first to third through paths, respectively. Furthermore, the first connection path 66 is connected to the first upper storage unit 41*a*. The second connection path 67 is connected to the second upper storage unit 42*a* and the third to fifth storing units 43 to 45. The third connection path 68 is connected to the first lower storage unit 41*b*, the second lower storage unit 42*b*, and the small storing unit 51.

[Operation Unit, Memory Unit, and Communication Unit]

The operation unit 15 to which an operation by the operator is given outputs a signal corresponding to the operation given by the operator. With such a configuration, the operator may operate the operation unit 15 to input the information. The output of the operation unit 15 is transmitted to the controller 18. For example, the memory unit 16 stores the information. The memory unit 16 stores information regarding an inventory amount of the banknotes in the paper sheet handling machine 1, control information for controlling the operation of the paper sheet handling machine 1 and the like. The communication unit 17 is provided to allow the controller 18 to perform wired communication or wireless communication with an external device (for example, a tablet terminal, a smartphone, and a management computer).

[Various Sensors]

Furthermore, various sensors such as a tracking sensor that detects passage of the banknote are provided on each unit of the paper sheet handling machine 1. Information obtained by these various sensors is transmitted to the controller 18.

[Controller]

The controller 18 is electrically connected to each unit of the paper sheet handling machine 1 and may transfer the signal and information to and from each unit of the paper sheet handling machine 1. In this example, the controller 18 is electrically connected to the deposit unit 21, the dispense unit 22, the reject unit 23, the temporary storage unit 24, the recognition unit 25, the handling side transport unit 30, the first to fifth storing units 41 to 45, the small storing unit 51, the safe side transport unit 60, the operation unit 15, the memory unit 16, and the communication unit 17. Furthermore, the controller 18 may communicate with the external device via the communication unit 17. Then, the controller 18 controls each unit of the paper sheet handling machine 1 to control the operation of the paper sheet handling machine 1 based on the operation given to the operation unit 15, the signal and information transmitted from each unit (including the various sensors provided on each unit) of the paper sheet handling machine 1 and the external device and the like. For example, the controller 18 is formed of a processor, a program for operating the processor, a memory that stores information and the like.

[Deposit Handling]

When an operation indicating execution of the deposit handling is given to the operation unit 15, the controller 18 controls the operation of the paper sheet handling machine 1 so that the deposit handling is performed. In the deposit handling, the banknote inserted into the deposit unit 21 is fed from the deposit unit 21 to the handling side transport unit 30, transported to the recognition unit 25 by the handling side transport unit 30, and recognized by the recognition unit 25. In a case where the banknote recognized by the recognition unit 25 corresponds to a reject target, the banknote is transported to the reject unit 23. On the other hand, in a case where the banknote recognized by the recognition unit 25 does not correspond to the reject target, the banknote is transported to the temporary storage unit 24 and stored in the temporary storage unit 24. Thereafter, when an operation of approving deposit of the banknote is given to the operation unit 15, the banknote stored in the temporary storage unit 24 is fed to the handling side transport unit 30. The banknote fed to the handling side transport unit 30 is transported to any one of the first to fifth storing units 41 to 45 and the small storing unit 51 via the handling side transport unit 30 and the safe side transport unit 60 according to a recognition result of the banknote by the recognition unit 25. On the other hand, when an operation of canceling the deposit of the banknote is given to the operation unit 15, the banknote stored in the temporary storage unit 24 is transported to the dispense unit 22 and returned from the dispense unit 22.

[Dispense Handling]

When an operation indicating execution of the dispense handling is given to the operation unit 15, the controller 18 controls the operation of the paper sheet handling machine 1 so that the dispense handling is performed. In the dispense handling, the banknote stored in the storage unit being a target of the dispense handling out of the first to fifth storing units 41 to 45 and the small storing unit 51 is fed to the safe side transport unit 60, transported to the recognition unit 25 via the safe side transport unit 60 and the handling side transport unit 30, and is recognized by the recognition unit 25. In a case where the banknote recognized by the recognition unit 25 corresponds to the reject target, the banknote is transported to the temporary storage unit 24. On the other hand, in a case where the banknote recognized by the recognition unit 25 does not correspond to the reject target, the banknote is transported to the dispense unit 22 and dispensed from the dispense unit 22. When the dispense handling is completed, the banknote to be rejected stored in the temporary storage unit 24 is transported to any one of the first to fifth storing units 41 to 45 and the small storing unit 51.

[Handling Movable Unit (Second Unit)]

Next, a configuration of the handling movable unit 11*b* is described with reference to FIG. 2. As described above, the handling movable unit 11*b* includes the handling side transport unit 30. The handling side transport unit 30 includes the ring road 300. The handling movable unit 11*b* is an example of a second unit.

In the following description, a first direction is a horizontal direction. The horizontal direction is a direction orthogonal to the up-down direction. A second direction is a direction opposite to the first direction. In this example, the first direction is the direction from the rear side to the front side, and a first direction side is the front side. The second direction is the direction from the front side to the rear side, and a second direction side is the rear side. Furthermore, the first direction is the direction in which the handling movable unit 11*b* is pulled out from the handling housing 11*a*, and the second direction is the direction in which the handling movable unit 11*b* is pushed into the handling housing 11*a*.

[Ring Road]

The ring road 300 includes a first transport path 301, a second transport path 302, a third transport path 303, and a fourth transport path 304. The first transport path 301 extends in the first direction. The second transport path 302 extends in the first direction and faces the first transport path 301 at an interval in the up-down direction. The second transport path 302 is arranged above the first transport path 301. The third transport path 303 connects one end of the first transport path 301 and one end of the second transport path 302. The fourth transport path 304 connects the other end of the first transport path 301 and the other end of the second transport path 302.

[First Transport Path]

Figure 4:
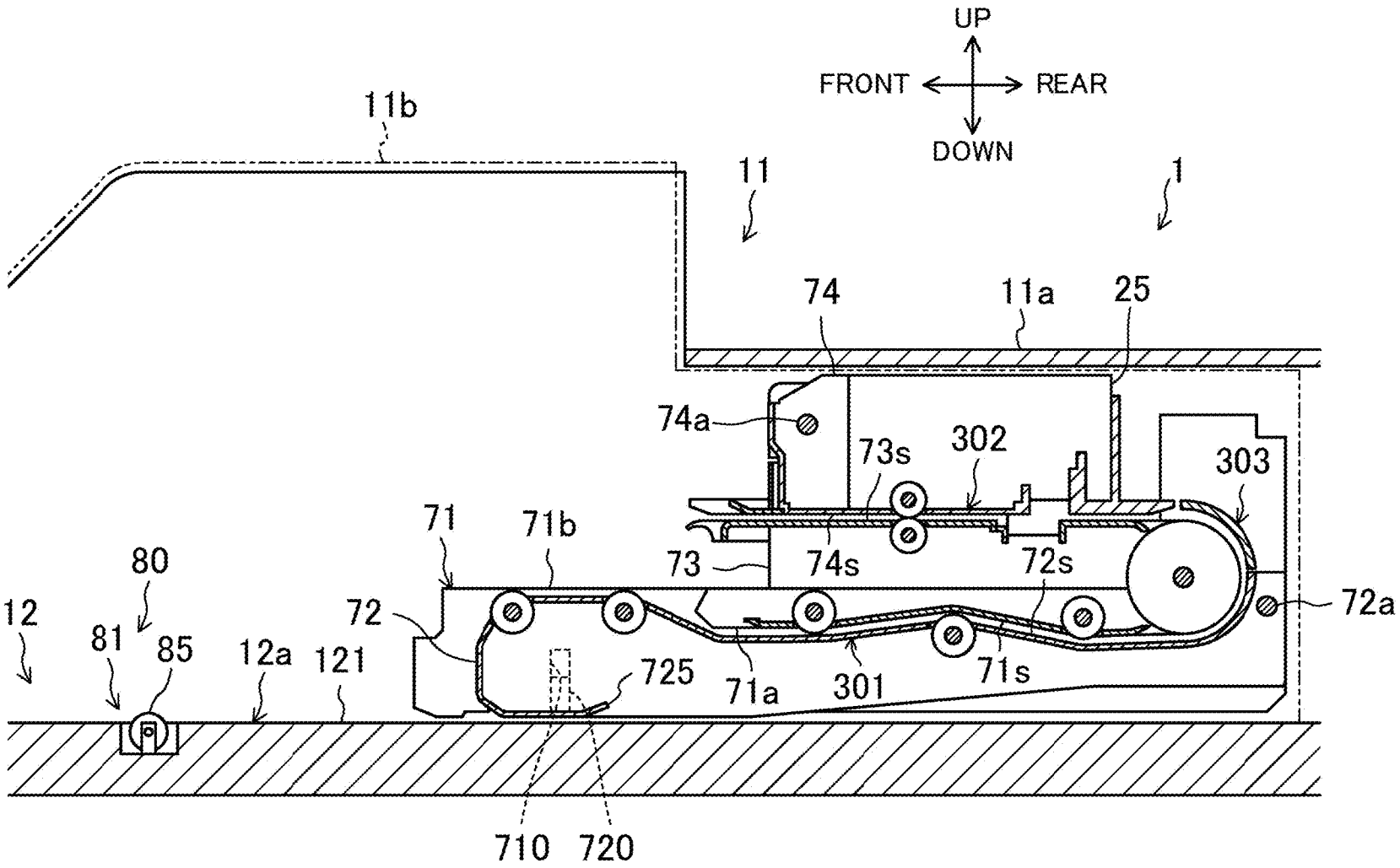
FIG. 4 is a schematic cross-sectional view illustrating a configuration of a substantial part of the paper sheet handling machine.
Figure 5:
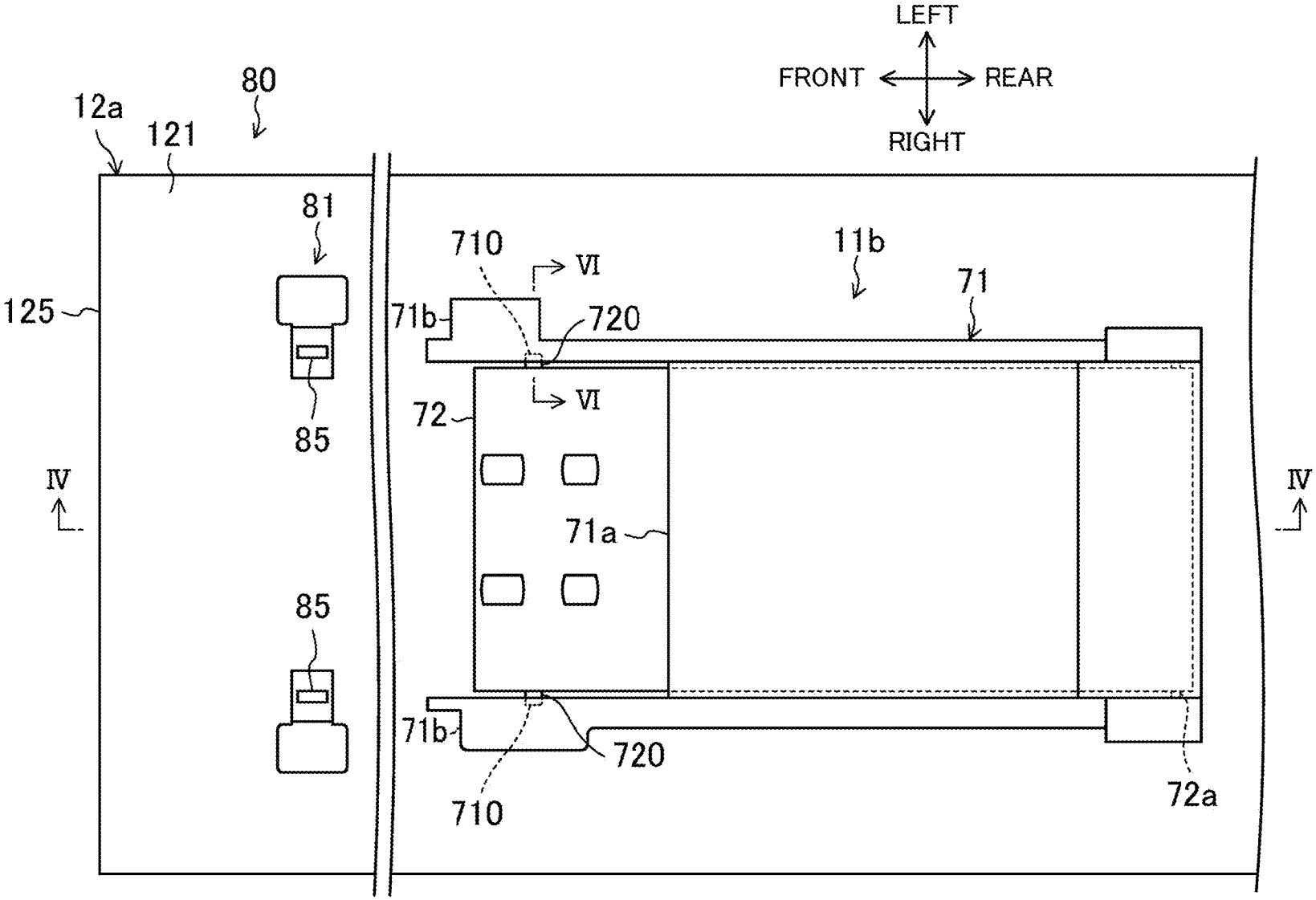
FIG. 5 is a schematic plan view illustrating the configuration of the substantial part of the paper sheet handling machine.

Next, a configuration of the first transport path 301 is described with reference to FIGS. 4 and 5. Note that FIG. 4 corresponds to a cross-sectional view taken along line IV-IV in FIG. 5. Note that FIG. 4 illustrates only the configuration related to the first transport path 301 and the second transport path 302 among the handling movable units 11*b*. In FIG. 5, the second transport path 302 and the third transport path 303 are not illustrated. The first transport path 301 includes a first portion 71 and a second portion 72.

<First Portion>

The first portion 71 extends in the first direction.

Specifically, the first portion 71 includes a central portion 71*a* and a pair of side walls 71*b*. The central portion 71*a* is formed into a plate shape. A plate thickness direction of the central portion 71*a* is the up-down direction. A first transport surface 71*s* is formed on the central portion 71*a*. In this example, the first transport surface 71*s* is formed in a lower portion of the central portion 71*a*. The pair of side walls 71*b* face each other at an interval in the direction orthogonal to the first direction and horizontal. The central portion 71*a* is arranged between the pair of side walls 71*b*. Each of the pair of side walls 71*b* is formed into a plate shape. A plate thickness direction of each of the pair of side walls 71*b* is a direction in which the pair of side walls 71*b* face each other. Note that the pair of side walls 71*b* face each other in a direction in which a first swing shaft 72*a* to be described later extends.

<Second Portion>

The second portion 72 extends along the first portion 71. The second portion 72 is swingable with respect to the first portion 71 about a first swing axis. The first swing axis extends in the direction orthogonal to the first direction and horizontal. The second portion 72 is engageable with the first portion 71. In a state in which the handling movable unit 11*b* is arranged in the handling housing 11*a* (above the safe housing 12*a*) and the first portion 71 and the second portion 72 engage with each other, the second portion 72 is arranged on the safe housing 12*a* side of the central portion 71*a* of the first portion 71. A free end of the second portion 72 is located on the first direction side than the first swing axis. In this example, the first swing axis extends in the right-left direction. The second portion 72 is arranged below the first portion 71. The free end of the second portion 72 is located anterior to the first swing axis. Here, the free end of the second portion 72 refers to the end of the second portion 72 that swings with respect to the first portion 71 on the first transport path 301. In detail, the free end of the second portion 72 refers to the end farther from the swing center out of a front end and a rear end in the first direction when the second portion 72 is swung with respect to the first portion 71 about the first swing axis (the end in which an amount of movement of the second portion 72 with respect to the first portion 71 is larger).

Specifically, the second portion 72 is formed into a plate shape. A plate thickness direction of the second portion 72 is the up-down direction. The second portion 72 is provided with a first swing shaft 72*a*. An axis of the first swing shaft 72*a* forms the first swing axis. The second portion 72 is swingable with respect to ends on the second direction side of the pair of side walls 71*b* of the first portion 71 about the first swing shaft 72*a*. Furthermore, the second portion 72 is provided with a second transport surface 72*s*. In this example, the first swing shaft 72*a* is supported by rear ends of the pair of side walls 71*b*. The second transport surface 72*s* is formed on an upper portion of the second portion 72.

Furthermore, the second portion 72 is provided with an abutment portion 725. The abutment portion 725 is a portion that comes into contact with a raised portion 81 described later. The abutment portion 725 is provided on the free end of the second portion 72. The abutment portion 725 extends along the free end of the second portion 72. An end of the abutment portion 725 on a first swing axis side is inclined toward the inside of the second portion 72. In this example, the abutment portion 725 is provided on a lower side of the front end of the second portion 72, and a rear end of the abutment portion 725 is inclined upward.

Note that at least an outer frame of the second portion 72 is made of resin. The outer frame of the second portion 72 is a portion including an outer surface of the second portion 72.

<State of First Transport Path>

The first transport path 301 is put into a first state in which the banknote between the first portion 71 and the second portion 72 is transportable when the first portion 71 engages with the second portion 72. Furthermore, the first transport path 301 is put into a second state in which the second portion 72 is swingable with respect to the first portion 71 about the first swing axis when the engagement between the first portion 71 and the second portion 72 is released.

In a case where the first transport path 301 is in the first state, the first transport surface 71*s* of the first portion 71 and the second transport surface 72*s* of the second portion 72 face each other at a predetermined interval in the up-down direction. The banknote is transported between the first transport surface 71*s* and the second transport surface 72*s*.

Figure 7:
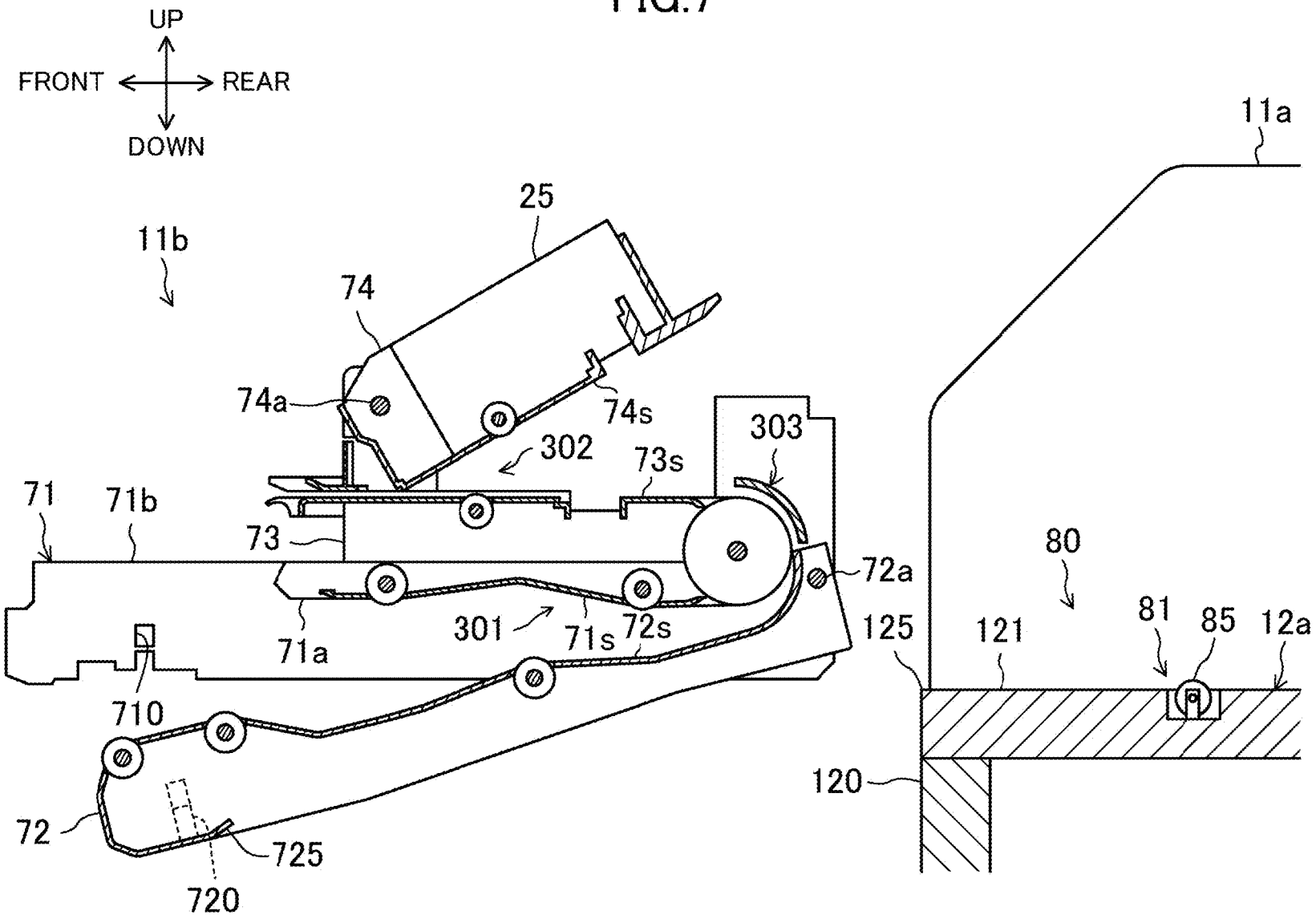
FIG. 7 is a schematic cross-sectional view for explaining a pulling out operation of a handling movable unit.

As illustrated in FIG. 7, when the first transport path 301 switches from the first state to the second state and the second portion 72 swings in a direction away from the first portion 71, the first transport path 301 opens on the first direction side and the first transport surface 71*s* of the first portion 71 and the second transport surface 72*s* of the second portion 72 are exposed. In other words, although the first transport surface 71*s* and the second transport surface 72*s* for sandwiching the banknote to be transported are not exposed in the first state of the first transport path 301, the first transport surface 71*s* and the second transport surface 72*s* that sandwich the banknote to be transported may be exposed in the second state of the first transport path 301.

<Engagement Portion>

The first portion 71 is provided with a first engagement portion 710. The second portion 72 is provided with a second engagement portion 720. The second engagement portion 720 may engage with the first engagement portion 710.

Specifically, the first engagement portion 710 is provided on a portion on the first direction side of the first portion 71. The second engagement portion 720 is provided on a portion on the first direction side of the second portion 72. In this example, the first engagement portion 710 is provided on each of front ends of the pair of side walls 71*b* of the first portion 71. A pair of second engagement portions 720 is provided on the front end of the second portion 72.

<Engagement Portion in Detail>

Figure 6:
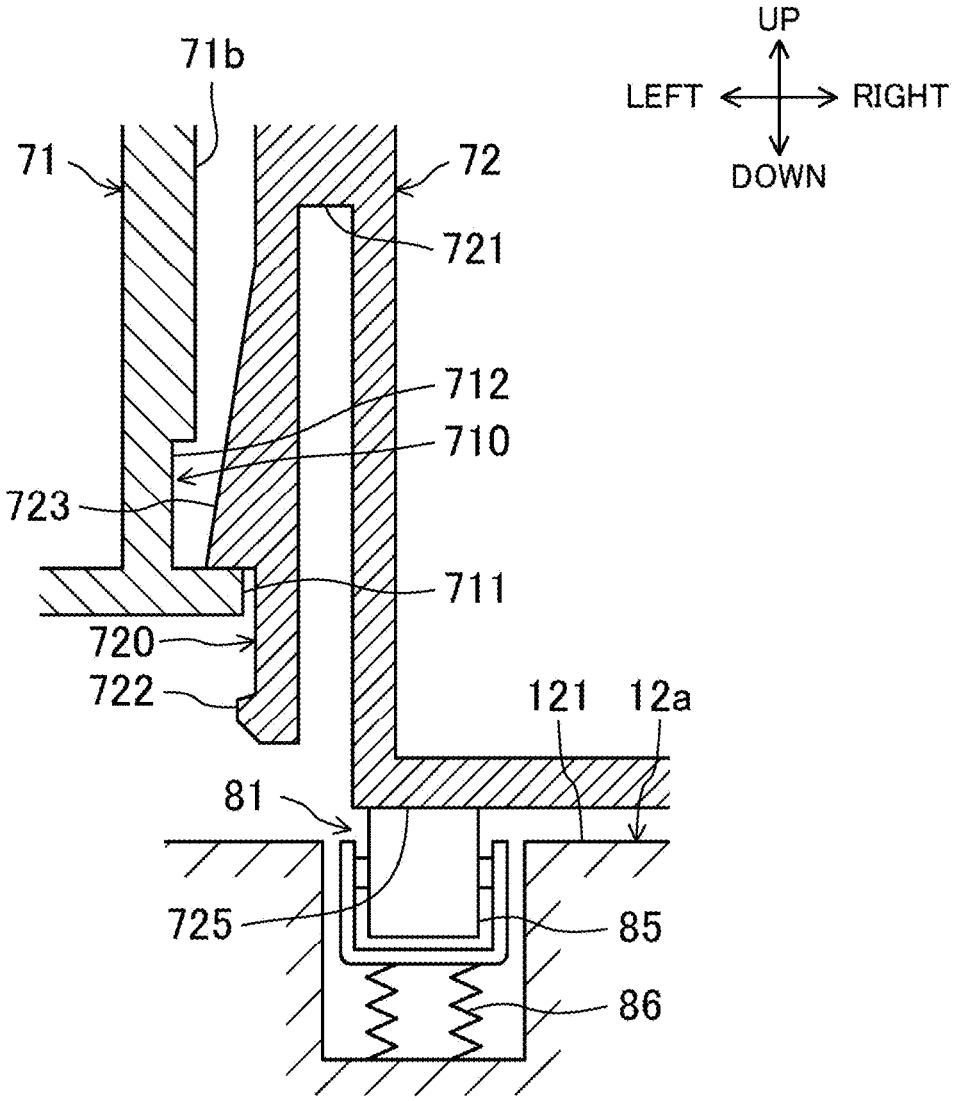
FIG. 6 is a schematic cross-sectional view illustrating a configuration of an engagement portion.

Next, the first engagement portion 710 and the second engagement portion 720 are described in detail with reference to FIG. 6. FIG. 6 corresponds to a cross-sectional view taken along line VI-VI in FIG. 5.

The first engagement portion 710 includes a first raised portion 711 and a recessed portion 712. The first raised portion 711 is provided on an inner side surface of the side wall 71*b* of the first portion 71. The recessed portion 712 is provided above the first raised portion 711 on the inner side surface of the side wall 71*b* of the first portion 71. The recessed portion 712 is provided so as to reduce contact with a second raised portion 723 to be described later.

The second engagement portion 720 includes a base 721, a movable piece 722, and the second raised portion 723. The base 721 is provided on right and left side surfaces of the second portion 72. The movable piece 722 extends downward from the base 721 and faces the side surface of the second portion 72 at an interval. The second raised portion 723 is provided on an outer side surface of the movable piece 722. A projecting height of the second raised portion 723 gradually increases from an upper side toward a lower side. That is, the second raised portion 723 includes an inclined surface that inclines out of the second portion 72 from the upper side toward the lower side.

When the second raised portion 723 is caught on the first raised portion 711, the first engagement portion 710 and the second engagement portion 720 engage with each other. When the movable piece 722 is pushed in a direction toward the side surface of the second portion 72, the second raised portion 723 caught on the first raised portion 711 is released. As a result, the second portion 72 becomes swingable in the direction away from the first portion 71.

When the second portion 72 away from the first portion 71 is pushed toward the first portion 71, the first raised portion 711 comes into contact with the inclined surface of the second raised portion 723. As the second portion 72 is further pushed into the first portion 71, the first raised portion 711 moves from the upper side toward the lower side of the inclined surface of the second raised portion 723, and the movable piece 722 bends in a direction approaching the side surface of the second portion 72. Then, when the first raised portion 711 passes through the second raised portion 723, the bend of the movable piece 722 is released, and the second raised portion 723 is caught on the first raised portion 711. As a result, the first engagement portion 710 and the second engagement portion 720 engage with each other.

[Second Transport Path]

Next, a configuration of the second transport path 302 is described with reference to FIG. 4. The second transport path 302 includes a third portion 73 and a fourth portion 74. The recognition unit 25 is provided on the fourth portion 74. An area (banknote transport area) formed between a third transport surface 73*s* of the third portion 73 and a fourth transport surface 74*s* of the fourth portion 74 is connected to an area (banknote transport area) formed between the first transport surface 71*s* of the first portion 71 and the second transport surface 72*s* of the second portion 72 via the third transport path 303.

<Third Portion>

The third portion 73 extends in the first direction. The third portion 73 is adjacent to the first portion in the up-down direction. In this example, the third portion 73 is arranged above the first portion 71.

Specifically, as is the case with the first portion 71, the third portion 73 includes a central portion and a pair of side walls. The central portion of the third portion 73 is formed into a plate shape, and a plate thickness direction of the central portion of the third portion 73 is the up-down direction. The third transport surface 73*s* is formed on the central portion of the third portion 73. In this example, the third transport surface 73*s* is formed on an upper portion of the central portion of the third portion 73. The pair of side walls of the third portion 73 face each other at an interval in the direction orthogonal to the first direction and horizontal. The central portion of the third portion 73 is arranged between the pair of side walls of the third portion 73. Each of the pair of side walls of the third portion 73 is formed into a plate shape, and a plate thickness direction of each of the pair of side walls of the third portion 73 is a direction in which the pair of side walls of the third portion 73 face each other. Note that the direction in which the pair of side walls of the third portion 73 face each other is a direction in which a second swing shaft 74*a* to be described later extends.

<Fourth Portion>

The fourth portion 74 extends along the third portion 73. The fourth portion 74 is swingable with respect to the third portion 73 about the second swing axis. The second swing axis extends in the direction orthogonal to the first direction and horizontal. The fourth portion 74 is engageable with the third portion 73. In a state in which the third portion 73 and the fourth portion 74 engage with each other, the fourth portion 74 is arranged on a side opposite to the first portion 71 of the third portion 73. A free end of the fourth portion 74 is located on the second direction side than the second swing axis. In this example, the second swing axis extends in the right-left direction. The fourth portion 74 is arranged above the third portion 73. The free end of the fourth portion 74 is located posterior to the second swing axis. Here, the free end of the fourth portion 74 refers to the end of the fourth portion 74 that swings with respect to the third portion 73 on the second transport path 302. In detail, the free end of the fourth portion 74 refers to the end farther from the swing center out of a front end and a rear end in the first direction (the end in which an amount of movement of the fourth portion 74 with respect to the third portion 73 is larger) when the fourth portion 74 is swung with respect to the third portion 73 about the second swing axis.

Specifically, the fourth portion 74 is formed into a plate shape. A plate thickness direction of the fourth portion 74 is the up-down direction. The second swing shaft 74*a* is provided on the fourth portion 74. An axis of the second swing shaft 74*a* forms the second swing axis. The second swing shaft 74*a* is rotatably supported by ends on the first direction side of the pair of side walls of the third portion 73. Furthermore, the fourth portion 74 is provided with the fourth transport surface 74*s*. In this example, the second swing shaft 74*a* is supported by rear ends of the pair of side walls of the third portion 73. The second transport surface 72*s* is formed on an upper portion of the third portion 73.

<State of Second Transport Path>

The second transport path 302 is put into a third state in which the banknote between the third portion 73 and the fourth portion 74 is transportable when the third portion 73 and the fourth portion 74 engage with each other. Furthermore, the second transport path 302 is put into a fourth state in which the fourth portion 74 is swingable with respect to the third portion 73 about the second swing axis when the engagement between the third portion 73 and the fourth portion 74 is released.

In a case where the second transport path 302 is in the third state, the third transport surface 73*s* of the third portion 73 and the fourth transport surface 74*s* of the fourth portion 74 face each other at a predetermined interval in the up-down direction. The banknote is transported between the third transport surface 73*s* and the fourth transport surface 74*s*.

As illustrated in FIG. 7, when the second transport path 302 switches from the third state to the fourth state and the fourth portion 74 swings in a direction away from the third portion 73, the second transport path 302 opens on the second direction side and the third transport surface 73*s* of the third portion 73 and the fourth transport surface 74*s* of the fourth portion 74 are exposed.

Note that, as an engagement mechanism between the third portion 73 and the fourth portion 74, a known configuration of an engagement mechanism may be employed. Furthermore, in the second transport path 302, a swingable range of the fourth portion 74 is limited so that an angle between the third portion 73 and the fourth portion 74 does not exceed 90° in the fourth state. In other words, the fourth portion 74 swings with respect to the third portion 73 in a range from 0° to 90°.

[Safe Housing (First Unit)]

Next, the safe housing 12*a* is described with reference to FIGS. 4 and 5. Note that the safe housing 12*a* is an example of the first unit.

The safe housing 12*a* extends in the first direction. A storage unit that stores the banknote is provided inside the safe housing 12*a*. The door 120 for exposing the inside of the safe housing 12*a* is provided on an end on the first direction side of the safe housing 12*a*. In this example, the door 120 is provided on a front end of the safe housing 12*a*.

The safe housing 12*a* includes a facing surface 121 and a corner 125. In this example, the facing surface 121 is a flat surface and is an upper end face of the safe housing 12*a*. The corner 125 is a corner on an upper front portion of the safe housing 12*a*. The facing surface 121 and the corner 125 are described later in detail.

[Contact Portion]

The safe housing 12*a* includes a contact portion 80. The contact portion 80 comes into contact with the second portion 72 to engage the second portion 72 with the first portion 71 when the handling movable unit 11*b* in which the first transport path 301 is in the second state is moved in the second direction.

Specifically, the safe housing 12*a* includes the raised portion 81. The contact portion 80 includes the raised portion 81 and the corner 125 of the safe housing 12*a*.

<Raised Portion>

The raised portion 81 is provided on the facing surface 121 of the safe housing 12*a*. The raised portion 81 is provided on the side closer to the door 120 than the center of the safe housing 12*a* in the first direction. The facing surface 121 of the safe housing 12*a* faces the handling movable unit 11*b* when the handling movable unit 11*b* in which the first transport path 301 is in the second state is moved in the second direction. The raised portion 81 comes into contact with the second portion 72 of the handling movable unit 11*b* to engage the second portion 72 with the first portion 71 when the handling movable unit 11*b* in which the first transport path 301 is in the second state is moved in the second direction.

<Roller>

In this example, the raised portion 81 includes a plurality of rollers 85. Each of the plurality of rollers 85 rotates about a rotation axis extending in a direction orthogonal to the second direction and horizontal. The plurality of rollers 85 is arranged in a direction in which the first swing axis of the second portion 72 extends. In this example, a pair of rollers 85 is arranged in the right-left direction. The pair of rollers 85 is arranged in positions contactable with the abutment portion 725 of the second portion 72. Note that the roller 85 is an example of a projection.

<Corner of Safe Housing>

The corner 125 of the safe housing 12*a* comes into contact with the second portion 72 of the handling movable unit 11*b* to guide movement of the second portion 72 to the first portion 71 when the handling movable unit 11*b* in which the first transport path 301 is in the second state is moved in the second direction.

<Biasing Member>

Furthermore, as illustrated in FIG. 6, the safe housing 12*a* is provided with a biasing member 86. The biasing member 86 biases the raised portion 81 toward the handling movable unit 11*b* when the handling movable unit 11*b* in which the first transport path 301 is in the second state is moved in the second direction. For example, the biasing member 86 is a spring. In this example, a plurality of biasing members 86 corresponding to the plurality of rollers 85 is provided. The biasing member 86 biases the roller 85 upward. Note that in FIGS. 4 and 7 to 12, the biasing member 86 is not illustrated.

[Pulling Out Operation of Handling Movable Unit]

Next, with reference to FIG. 7, an operation of pulling out the handling movable unit 11*b* from a predetermined position is described. Note that the predetermined position is a position where the handling movable unit 11*b* is arranged for allowing the first transport path 301 of the handling movable unit 11*b* to serve as the transport path of the paper sheet handling machine 1. In this example, the predetermined position is a position inside the handling housing 11*a* (above the safe housing 12*a*), and specifically the position illustrated in FIG. 4. In the predetermined position, the handling movable unit 11*b* faces the safe housing 12*a* in the up-down direction. When the handling movable unit 11*b* is arranged in the predetermined position, the first to third communication paths 321 to 323 connected to the ring road 300 including the first transport path 301 are connected to the first to third connection paths 66 to 68 of the safe side transport unit 60 via the first to third through paths of the safe housing 12*a*, respectively. As a result, the first transport path 301 serves as the transport path of the paper sheet handling machine 1.

As illustrated in FIG. 7, the operator pulls out the handling movable unit 11*b* forward. Next, the operator manually release the engagement between the first portion 71 and the second portion 72 of the handling movable unit 11*b*, and switches the first transport path 301 of the handling movable unit 11*b* from the first state to the second state. As a result, the second portion 72 swings in the direction away from the first portion 71 by its own weight. As a result, the first transport path 301 of the handling movable unit 11*b* opens forward, and the first transport surface 71*s* of the first portion 71 and the second transport surface 72*s* of the second portion 72 are exposed.

Furthermore, the operator manually releases the engagement between the third portion 73 and the fourth portion 74 of the handling movable unit 11*b*, and switches the second transport path 302 of the handling movable unit 11*b* from the third state to the fourth state. Next, the operator holds the fourth portion 74 by hand and swings the fourth portion 74 in the direction away from the third portion. As a result, the second transport path 302 of the handling movable unit 11*b* opens rearward, and the third transport surface 73*s* of the third portion 73 and the fourth transport surface 74*s* of the fourth portion 74 are exposed. Note that when the operator releases his/her hand from the fourth portion 74, the fourth portion 74 swings in the direction approaching the third portion 73 by its own weight. As a result, the second transport path 302 is closed, and the third portion 73 and the fourth portion 74 engage with each other. As a result, the second transport path 302 of the handling movable unit 11*b* returns from the fourth state to the third state.

[Returning Operation of First Transport Path of Handling Movable Unit]

Next, an operation of returning the handling movable unit 11*b* to the predetermined position after returning the first transport path 301 from the second state to the first state is described. In the example illustrated in FIGS. 7 to 11, an operation of returning the first transport path 301 in a state in which the engagement between the second portion 72 and the first portion 71 pulled out in the first direction is released and the second portion 72 is swung with respect to the first portion 71 to a state capable of transporting the paper sheet (see FIG. 4) is described.

This returning operation is performed by either a first returning operation or a second returning operation. The first returning operation is performed as follows: the operator swings the second portion 72 swung downward upward to engage the second portion 72 with the first portion 71, then pushes the first transport path 301 in the second direction. The second returning operation is performed as follows: the operator pushes the first transport path 301 in the second direction in a state in which the second portion 72 is swung downward.

<First Returning Operation>

First, the first returning operation is described.

The operator manually pushes the second portion 72 of the handling movable unit 11*b* into the first portion 71 to engage the second portion 72 with the first portion 71. As a result, the first transport path 301 of the handling movable unit 11*b* is switched from the second state to the first state. After that, the operator pushes the handling movable unit 11*b* in which the first transport path 301 returns from the first state to the second state rearward to the predetermined position in the handling housing 11*a*. As a result, as illustrated in FIG. 4, the handling movable unit 11*b* is arranged in the predetermined position.

<Second Returning Operation>

Next, the second returning operation is described. The second returning operation is an operation of returning the handling movable unit 11*b* to the predetermined position without returning the first transport path 301 from the second state to the first state without temporarily engaging the second portion 72 with the first portion 71 by the operator.

In the state illustrated in FIG. 7, the operator pushes the handling movable unit 11*b* in which the first transport path 301 is in the second state rearward to the predetermined position in the handling housing 11*a*.

Figure 8:
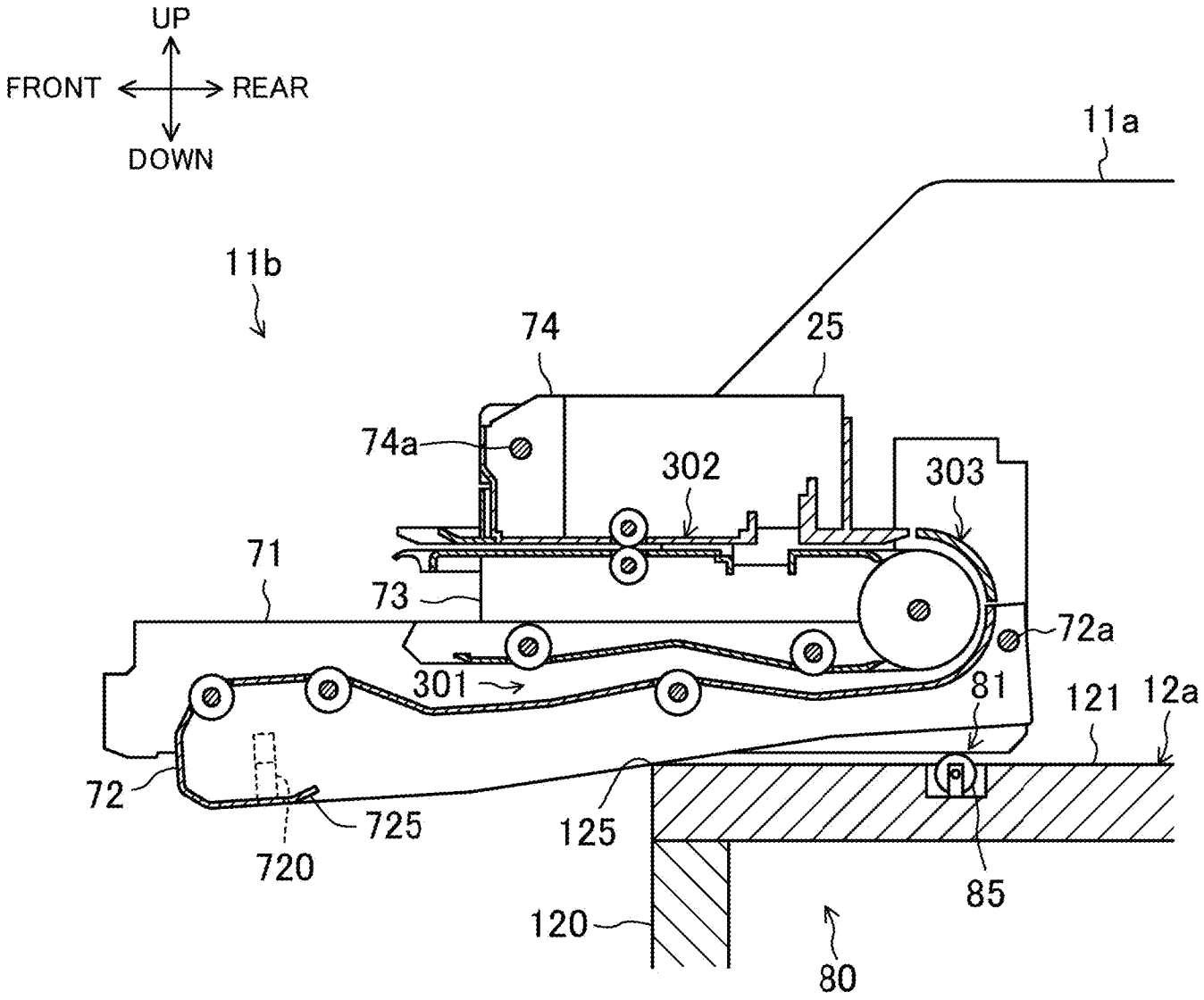
FIG. 8 is a schematic cross-sectional view for explaining contact between the handling movable unit and a safe housing in a second returning operation.

As illustrated in FIG. 8, when the handling movable unit 11*b* advances rearward, the corner 125 of the safe housing 12*a* comes into contact with the second portion 72 of the handling movable unit 11*b*. As a result, as the handling movable unit 11*b* advances rearward, the second portion 72 is guided in a direction approaching the first portion 71 by the corner 125 of the safe housing 12*a*.

Figure 9:
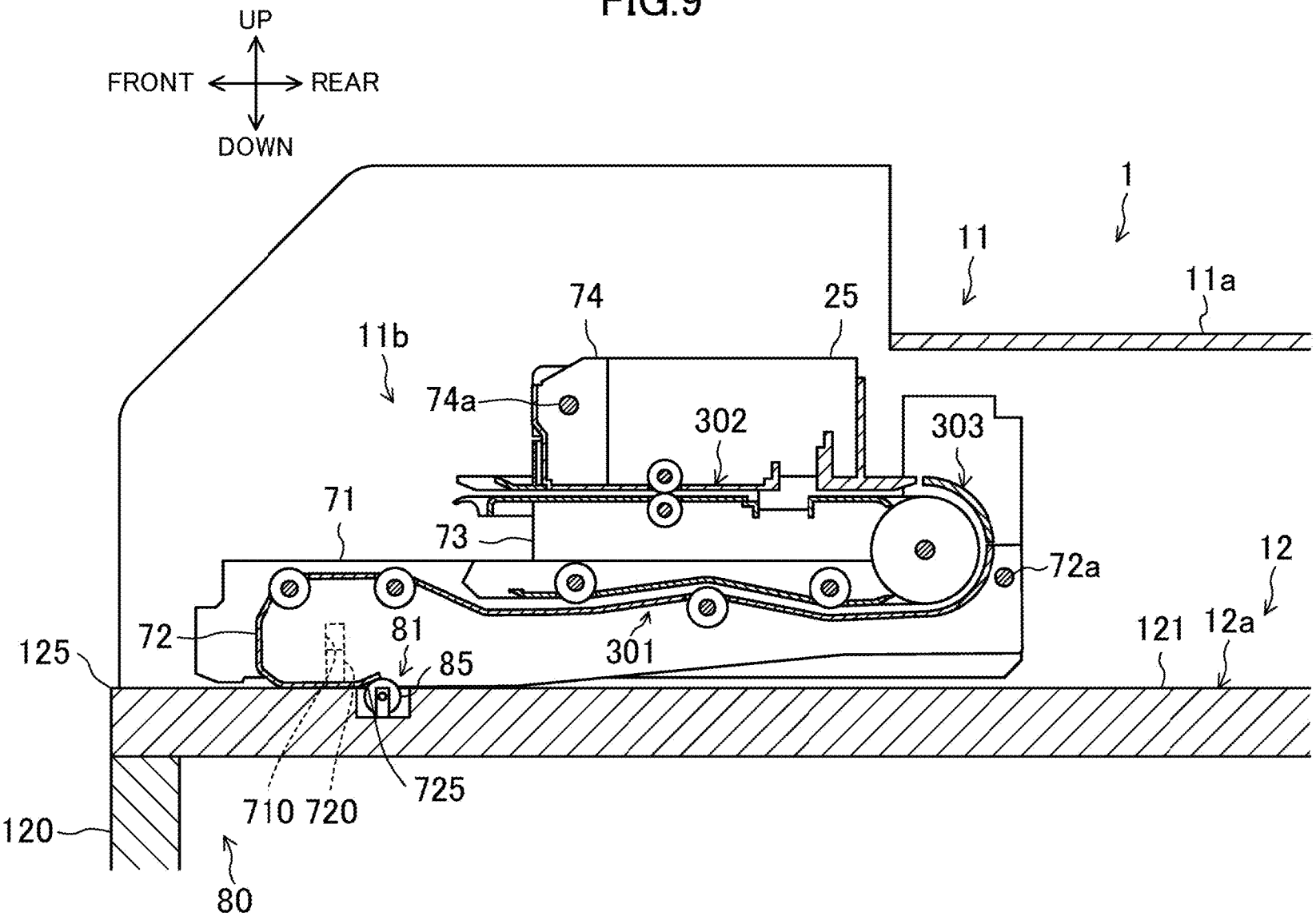
FIG. 9 is a schematic cross-sectional view for explaining contact between the handling movable unit and a raised portion in the second returning operation.

As illustrated in FIG. 9, when the handling movable unit 11*b* advances further rearward, the abutment portion 725 of the second portion 72 of the handling movable unit 11*b* comes into contact with the roller 85. As a result, as the handling movable unit 11*b* advances rearward, the second portion 72 is pushed into the first portion 71 by the roller 85.

Figure 10:
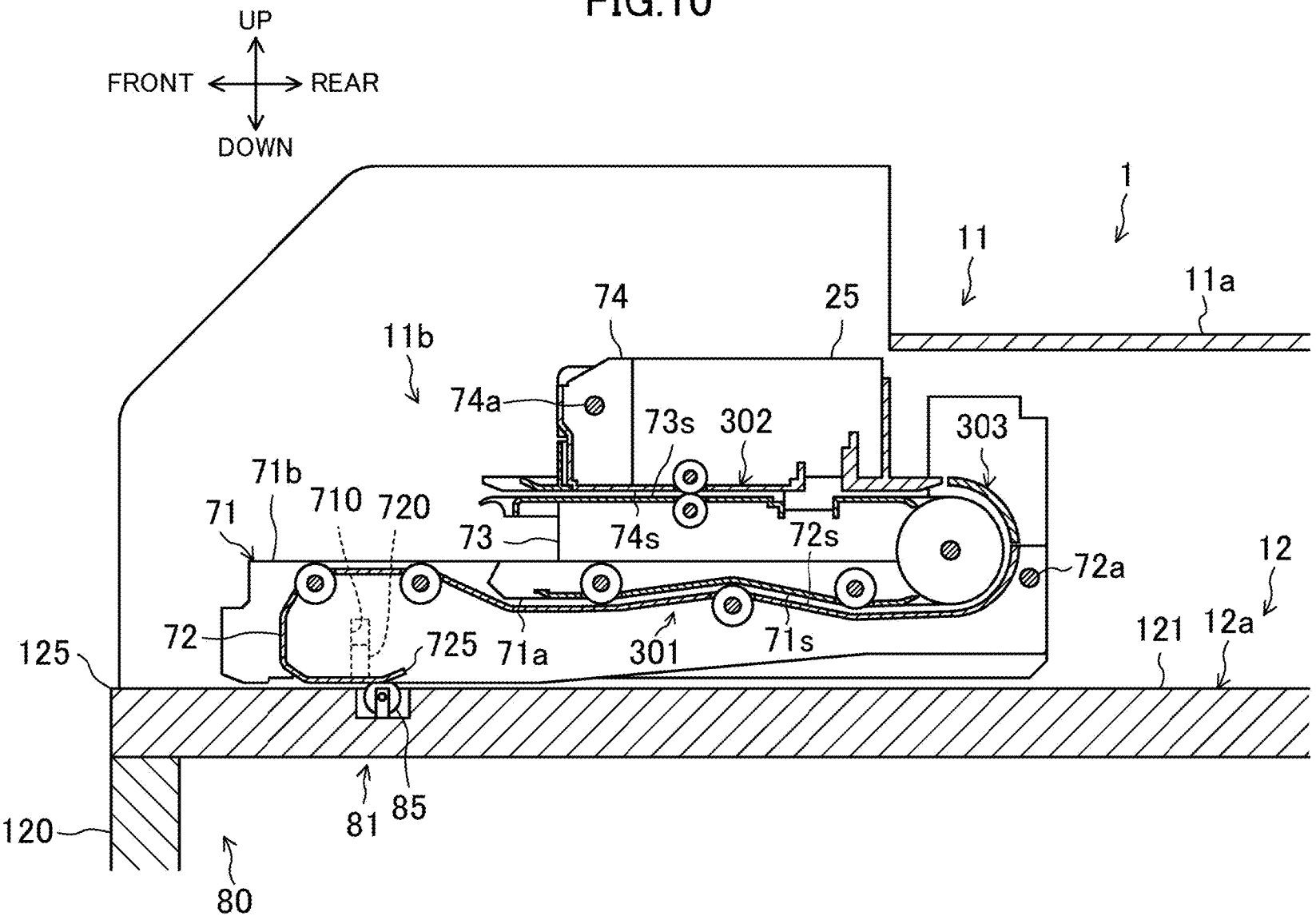
FIG. 10 is a schematic cross-sectional view for explaining engagement between a first portion and a second portion of the handling movable unit in the second returning operation.

As illustrated in FIG. 10, when the handling movable unit 11*b* advances further rearward and the pushing of the second portion 72 into the first portion 71 is completed, the first engagement portion 710 of the first portion 71 and the second engagement portion 720 of the second portion 72 engage with each other. As a result, the first transport path 301 of the handling movable unit 11*b* is switched from the second state to the first state. Then, as illustrated in FIG. 4, the handling movable unit 11*b* is arranged in the predetermined position.

As described above, the paper sheet handling machine 1 is provided with the safe housing 12*a* as a lower unit and the handling movable unit 11*b* as an upper unit. The handling movable unit 11*b* includes the transport path 301 that transports the paper sheet to the safe housing 12*a*. The handling movable unit 11*b* is movable in the first direction being a forward direction with respect to the safe housing 12*a*. The transport path 301 includes the first portion 71 and the second portion 72 extending in the first direction. The transport path 301 is configured to take a mode in the first state in which the first portion 71 and the second portion 72 engage with each other or the second state in which the engagement between the first portion 71 and the second portion 72 is released. Furthermore, when the paper sheet handling machine 1 is in a state capable of handling the paper sheet, the engaged first portion 71 and second portion 72 (transport path 301 in the first state) are arranged in a position in which they may transport the paper sheet as the transport path of the paper sheet handling machine 1 (see FIGS. 4 and 11). Furthermore, the paper sheet handling machine 1 may take a mode of the transport path 301 in the second state in which the handling movable unit 11*b* is moved in the first direction being the forward direction and the engagement between the first portion 71 and the second portion 72 which are engaged is released. By releasing the engagement between the first portion 71 and the second portion 72, it is put into the second state in which the second portion 72 is swingable with respect to the first portion 71 about the first swing axis. By swinging the second portion 72 with respect to the first portion 71 about the first swing axis, the transport path 301 is put into the state illustrated in FIG. 7, and the operator may perform the operation on the area between the second portion 72 and the first portion 71, for example. When the operation is finished, the engagement between the first portion 71 and the second portion 72 in the transport path 301 is completed (the transport path 301 is returned from the second state to the first state), and the transport path 301 is returned to the position in which this may transport the paper sheet as the transport path of the paper sheet handling machine 1. At that time, either the first returning operation or the second returning operation described above may be performed. In a case where the second returning operation is performed, as illustrated in FIGS. 7 to 10, the handling movable unit 11*b* in the second state in which the second portion 72 is swung with respect to the first portion 71 about the first swing axis is moved rearward and the contact portion 80 is brought into contact with the second portion 72, thereby engaging the second portion 72 with the first portion 71. After that, the handling movable unit 11*b* is moved rearward and returned to its initial position. As a result, the engaged first portion 71 and second portion 72 (transport path 301 in the first state) are arranged in positions where they may transport the paper sheet as the transport path of the paper sheet handling machine 1 (see FIGS. 4 and 11).

[Effects of Embodiment]

As described above, in the pulling out operation, by switching the first transport path 301 of the handling movable unit 11*b* from the first state to the second state after moving the handling movable unit 11*b* in the first direction with respect to the safe housing 12*a*, it is possible to swing the second portion 72 of the first transport path 301 in the direction away from the first portion 71 to expose the first transport path 301 forward. As a result, the first transport path 301 may be checked.

Furthermore, in a first pushing operation after the pulling out operation, by moving the handling movable unit 11*b* in the second direction after returning the first transport path 301 of the handling movable unit 11*b* from the second state to the first state, it is possible to allow the first transport path 301 of the handling movable unit 11*b* to normally serve as the transport path of the paper sheet handling machine 1.

Note that, in a second pushing operation after the pulling out operation, even when the handling movable unit 11*b* is moved in the second direction to the predetermined position without returning the first transport path 301 from the second state to the first state, it is possible to return the first transport path 301 from the second state to the first state by bringing the raised portion 81 of the contact portion 80 into contact with the second portion 72 of the handling movable unit 11*b* and engaging the second portion 72 with the first portion 71. As a result, the first transport path 301 of the handling movable unit 11*b* may be reliably returned to the first state (state in which the paper sheet may be transported).

In a case where only the first returning operation may be performed, the operator reliably manually returns the first transport path 301 of the handling movable unit 11*b* from the second state to the first state, then moves the handling movable unit 11*b* in the second direction. Therefore, an operation of moving the handling movable unit 11*b* in the second direction is troublesome. On the other hand, in this paper sheet handling machine 1, since the second returning operation may be performed in addition to the first returning operation, it is not necessary to reliably manually return the first transport path 301 of the handling movable unit 11*b* from the second state to the first state before moving the handling movable unit 11*b* in the second direction. Therefore, the operation of moving the handling movable unit 11*b* in the second direction may be facilitated.

Furthermore, in the paper sheet handling machine 1, the raised portion 81 includes the roller 85. With such a configuration, the roller 85 brought into contact with the second portion 72 of the handling movable unit 11*b* moving in the second direction rotates, so that the movement of the handling movable unit 11*b* in the second direction may be made smooth.

Furthermore, in the paper sheet handling machine 1, the biasing member 86 is provided on the safe housing 12*a*. With such a configuration, a force with which the raised portion 81 pushes the second portion 72 toward the first portion 71 may be increased. As a result, the second portion 72 may be easily engaged with the first portion 71.

Furthermore, in the paper sheet handling machine 1, the raised portion 81 includes a plurality of rollers 85 arranged in the direction in which the first swing axis extends. With such a configuration, the second portion 72 may be pushed toward the first portion 71 over a wide range in the direction in which the first swing axis extends. As a result, the second portion 72 may be easily engaged with the first portion 71.

Furthermore, in the paper sheet handling machine 1, the first engagement portion 710 is provided on the portion on the first direction side of the first portion 71, and the second engagement portion 720 is provided on the portion on the first direction side of the second portion 72. With such a configuration, a pushing force necessary for engaging the second portion 72 with the first portion 71 may be reduced as compared with a case where the first and second engagement portions 710 and 720 are provided on portions opposite to the first direction side of the first and second portions 71 and 72, respectively. Note that the pushing force is the force with which the raised portion 81 pushes the second portion 72 toward the first portion 71. As a result, the second portion 72 may be easily engaged with the first portion 71.

Furthermore, in the paper sheet handling machine 1, the door 120 is provided on the end on the first direction side of the safe housing 12*a*. The raised portion 81 is provided on the side closer to the door 120 than the center of the safe housing 12*a* in the first direction. With such a configuration, it is possible to shorten a distance from the end on the first direction side of the safe housing 12*a* to the raised portion 81 as compared with a case where the raised portion 81 is provided closer on the side opposite to the door 120 than the center of the safe housing 12*a* in the first direction. As a result, the safe housing 12*a* may be made compact.

Furthermore, in the paper sheet handling machine 1, the corner 125 on the first direction side of the safe housing 12*a* comes into contact with the second portion 72 of the handling movable unit 11*b* to guide the movement of the second portion 72 toward the first portion 71 when the handling movable unit 11*b* in which the first transport path 301 is in the second state is moved in the second direction. With such a configuration, the second portion 72 of the handling movable unit 11*b* that moves in the second direction may be smoothly moved to the first portion 71. As a result, the second portion 72 may be easily engaged with the first portion 71.

Furthermore, in the paper sheet handling machine 1, at least the outer frame of the second portion 72 is made of resin. With such a configuration, an impact occurring by the contact between the second portion 72 and the contact portion 80 may be alleviated as compared with a case where the outer frame of the second portion 72 is made of metal.

Furthermore, in the paper sheet handling machine 1, the banknote may be normally transported in the second transport path 302 by putting the second transport path 302 into the third state. Furthermore, the second transport path 302 may be opened by putting the second transport path 302 into the fourth state. As a result, the second transport path 302 may be checked.

(Variation 1 of Embodiment)

Figure 11:
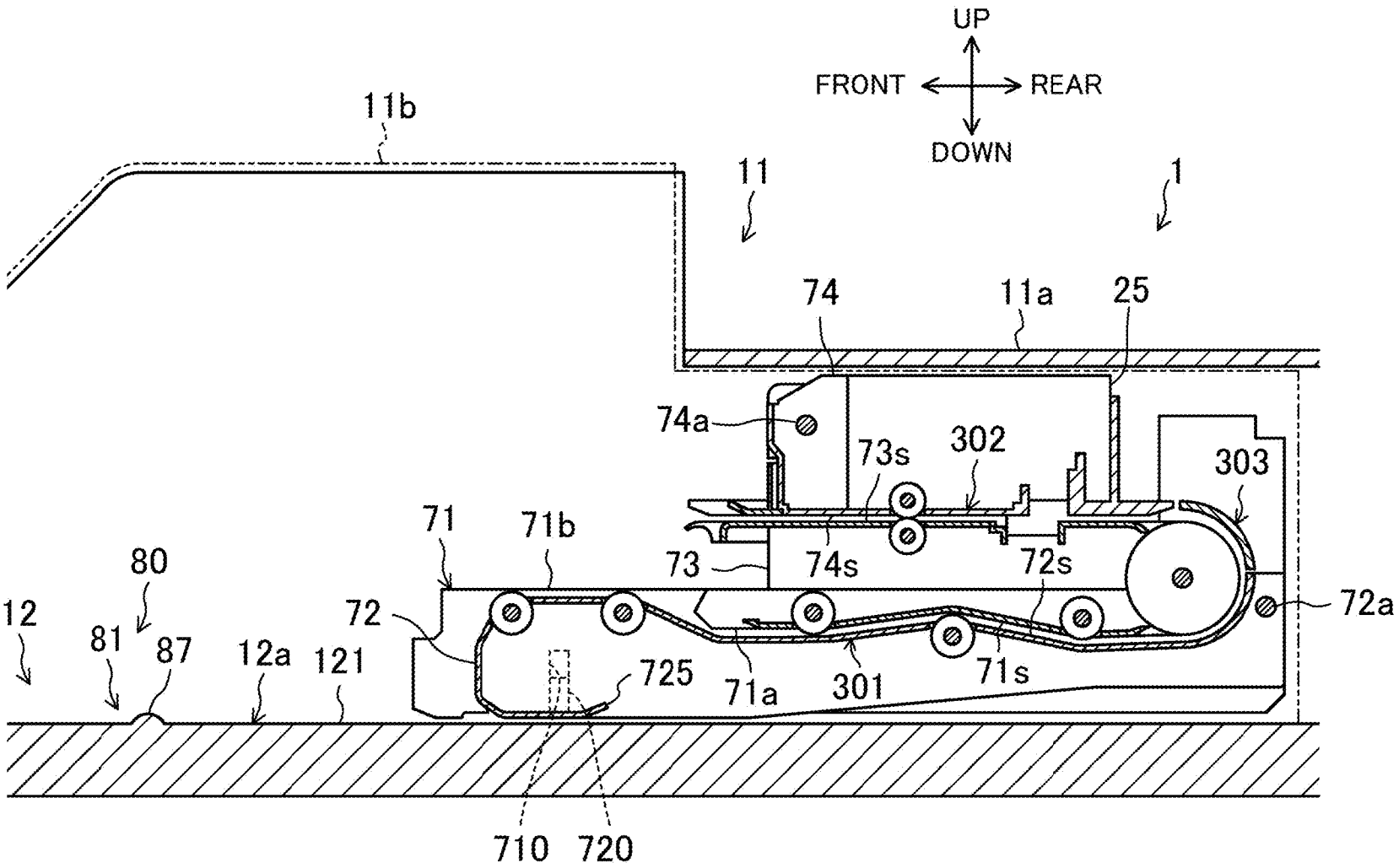
FIG. 11 is a schematic cross-sectional view illustrating a paper sheet handling machine of a variation 1 of the embodiment.

As illustrated in FIG. 11, the raised portion 81 may include a protrusion 87 instead of the roller 85 illustrated in FIG. 4. The protrusion 87 is such that at least a portion brought into contact with the second portion 72 is formed into an arc shape. Specifically, a cross-sectional shape in the first direction of at least the portion brought into contact with the second portion 72 of the protrusion 87 is formed into the arc shape. In this example, the cross-sectional shape of the protrusion 87 in the first direction is formed into a semicircular shape. Note that the protrusion 87 is an example of the projection.

In the paper sheet handling machine 1 of this variation 1 of this embodiment, sliding resistance between the second portion 72 of the handling movable unit 11*b* moving in the second direction and the protrusion 87 of the raised portion 81 may be reduced. As a result, the handling movable unit 11*b* may be smoothly moved in the second direction.

(Variation 2 of Embodiment)

Figure 12:
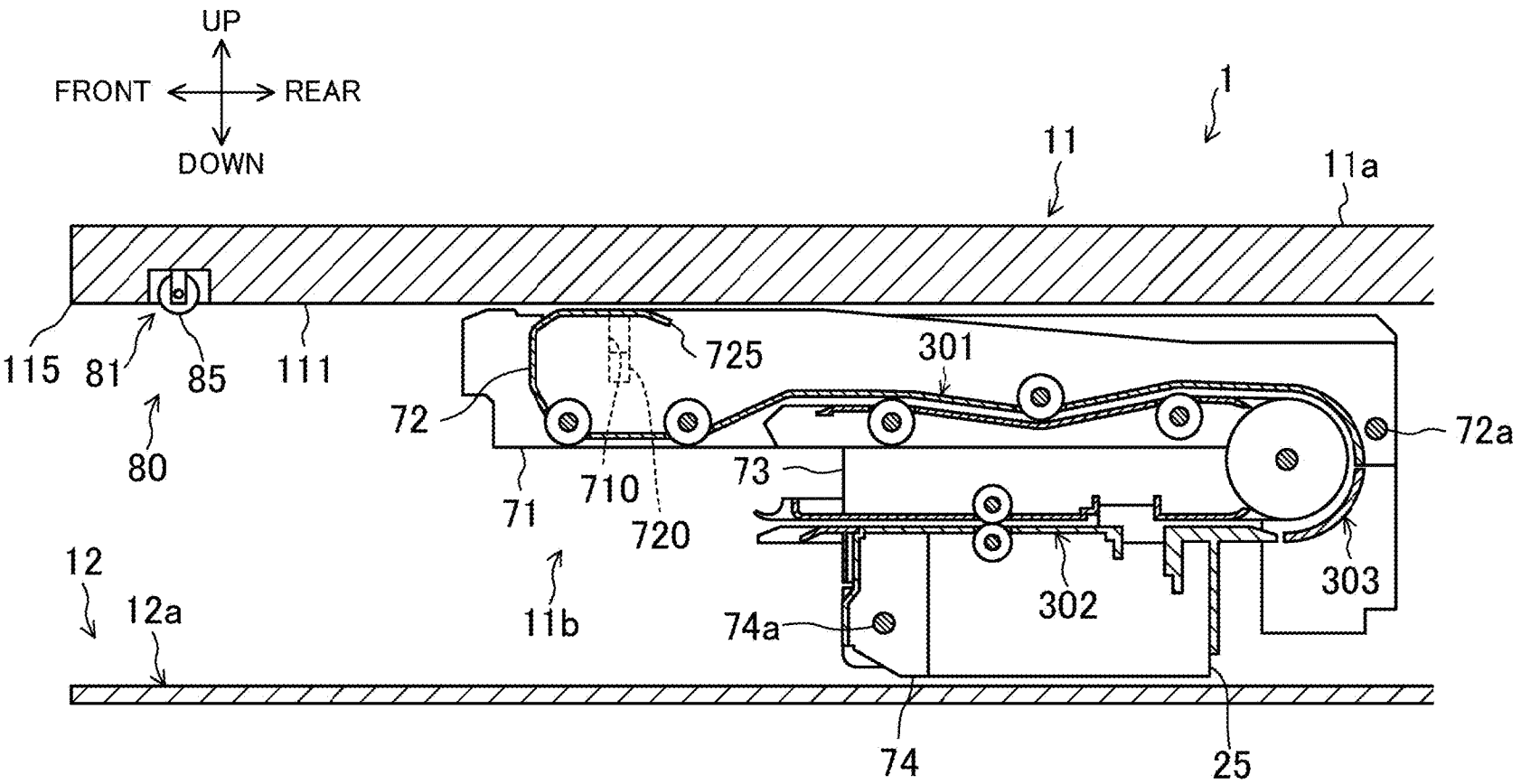
FIG. 12 is a schematic cross-sectional view illustrating a paper sheet handling machine of a variation 2 of the embodiment.

As illustrated in FIG. 12, the handling movable unit 11*b* may be reversed upside down. In this variation 2, in a state in which the handling movable unit 11*b* is arranged in the handling housing 11*a* (below an upper wall of the handling housing 11*a*) and the first portion 71 and the second portion 72 engage with each other, the second portion 72 is arranged on the handling housing 11*a* side of the central portion 71*a* of the first portion 71. That is, the second portion 72 is arranged above the first portion 71. The second portion 72 is swingable upward with respect to the first portion 71. The second transport path 302 is arranged below the first transport path 301. The fourth portion 74 is arranged below the third portion 73. The fourth portion 74 is swingable downward with respect to the third portion 73.

Furthermore, in the variation 2, the handling housing 11*a* includes the contact portion 80. In this variation 2, the raised portion 81 is provided on a facing surface 111 of the upper wall of the handling housing 11*a*. The facing surface 111 of the handling housing 11*a* faces the handling movable unit 11*b* when the handling movable unit 11*b* in which the first transport path 301 is in the second state is moved in the second direction. A corner 115 of the upper wall of the handling housing 11*a* comes into contact with the second portion 72 of the handling movable unit 11*b*, thereby guiding the movement of the second portion 72 to the first portion 71 when the handling movable unit 11*b* in which the first transport path 301 is in the second state in the second direction. In this variation 2, the handling housing 11*a* corresponds to the first unit.

In the paper sheet handling machine 1 of the variation 2 of this embodiment also, the effect similar to that of the embodiment may be obtained.

Another Embodiment

In the above description, the banknote is described as an example of the paper sheet handled by the paper sheet handling machine 1, but the present invention is not limited to this. For example, the paper sheet handling machine 1 may handle a check, a bill, a coupon and the like as other examples of the paper sheet.

Furthermore, although a case where the first direction is the direction from the rear side to the front side is given as an example in the above description, the present invention is not limited to this. For example, the first direction may be a direction from the front side to the rear side, or may be another direction.

Furthermore, the above-described embodiments may be implemented in combination as appropriate. The above-described embodiments are essentially preferred examples and are not intended to limit the scope of the technology herein disclosed, their applications, or their uses.

What is claimed is:

1. A paper sheet handling machine comprising:

a first body; and a second body provided above the first body and including a first transport that is configured to transport a paper sheet, wherein the first transport includes a first portion extending in a horizontal direction in a first direction from a rear side of the machine to a front side of the machine being opposite of the rear side of the machine, and a second portion provided below the first portion and being capable of engaging with the first portion, the first transport is in a first state in which the first transport is capable of transporting the paper sheet between the first portion and the second portion when the first portion and the second portion engage with each other, the first transport is in a second state in which the second portion is swingable in a direction away from the first portion and below the first portion by an own weight of the second portion about a first swing axis extending in a direction orthogonal to the first direction and horizontal when engagement between the first portion and the second portion is released, wherein the first body includes a facing surface that faces the second body when the second body of which the first transport is in the second state is moved in a second direction opposite to the first direction and a raised portion provided on the facing surface, and the raised portion comes into contact with the second portion of the second body, thereby engaging the second portion with the first portion, when the second body of which the first transport is in the second state is moved in the second direction, wherein the raised portion includes a roller that is configured to rotate about a rotation axis extending in a direction orthogonal to the second direction and horizontal.

2. The paper sheet handling machine of claim 1, wherein the facing surface is a flat surface, and at least a portion of the raised portion that comes into contact with the second portion is formed into an arc shape.

3. The paper sheet handling machine of claim 1, wherein a first engagement portion is provided on a portion on a first direction side of the first portion, and second engagement portion that is configured to engage with the first engagement portion is provided on a portion on the first direction side of the second portion.

4. The paper sheet handling machine of claim 1, wherein a storage that is configured to store the paper sheet is provided inside the first body, a door for exposing the inside of the first body is provided on an end on the first direction side of the first body, and the raised portion is provided on a side closer to the door than a center of the first body in the first direction.

5. The paper sheet handling achine of claim 1, wherein at least an outer frame of the second portion is made of resin.

6. A paper sheet handling machine, comprising:

a first body; and a second body provided above the first body and including a first transport that is configured to transport a paper sheet, wherein the first transport includes a first portion extending in a horizontal direction in a first direction from a rear side of the machine to a front side of the machine being -opposite of the rear side of the machine, and a second portion provided below the first portion and being capable of engaging with the first portion, the first transport is in a first state in which the first transport is capable of transporting the paper sheet between the first portion and the second portion when the first portion and the second portion engage with each other, the first transport is in a second state in which the second portion is swingable in a direction away from the first portion and below the first portion by an own weight of the second portion about a first swing axis extending in a direction orthogonal to the first direction and horizontal when engagement between the first portion and the second portion is released, wherein the first body includes a facing surface that faces the second body when the second body of which the first transport is in the second state is moved in a second direction opposite to the first direction and a raised portion provided on the facing surface, and the raised portion comes into contact with the second portion of the second body, thereby engaging the second portion with the first portion, when the second body of which the first transport is in the second state is moved in the second direction, wherein the first body is provided with a biasing member that biases the raised portion toward the second body when the second body of which the first transport is in the second stat is moved in the second direction.

7. The paper sheet handling machine of claim 6, wherein the facing surface is a flat surface, and at least a portion of the raised portion that comes into contact with the second portion is formed into an arc shape.

8. The paper sheet handling machine of claim 6, wherein a first engagement portion is provided on a portion on a first direction side of the first portion, and second engagement portion that is configured to engage with the first engagement portion is provided on a portion on the first direction side of the second portion.

9. The paper sheet handling machine of claim 6, wherein a storage that is configured to store the paper sheet is provided inside the first body, a door for exposing the inside of the first body is provided on an end on the first direction side of the first body, and the raised portion is provided on a side closer to the door than a center of the first body in the first direction.

10. A paper sheet handling machine, comprising:

a first body; and a second body provided above the first body and including a first transport that is configured to transport a paper sheet, wherein the first transport includes a first portion extending in a horizontal direction in a first direction from a rear side of the machine to a front side of the machine being opposite of the rear side of the machine, and a second portion provided below the first portion and being capable of engaging with the first portion, the first transport is in a first state in which the first transport is capable of transporting the paper sheet between the first portion and the second portion when the first portion and the second portion engage with each other, the first transport is in a second state in which the second portion is swingable in a direction away from the first portion and below the first portion by an own weight of the second portion about a first swing axis extending in a direction orthogonal to the first direction and horizontal when engagement between the first portion and the second portion is released, wherein the first body includes a facing surface that faces the second body when the second body of which the first transport is in the second state is moved in a second direction opposite to the first direction and a raised portion provided on the facing surface, and the raised portion comes into contact with the second portion of the second body, thereby engaging the second portion with the first portion, when the second body of which the first transport is in the second state is moved in the second direction, wherein the raised portion includes a plurality of projections, and the plurality of projections is arranged in a direction in which the first swing axis extends.

11. The paper sheet handling machine of claim 10, wherein the facing surface is a flat surface, and at least a portion of the raised portion that comes into contact with the second portion is formed into an arc shape.

12. The paper sheet handling machine of claim 10, wherein a first engagement portion is provided on a portion on a first direction side of the first portion, and second engagement portion that is configured to engage with the first engagement portion is provided on a portion on the first direction side of the second portion.

13. The paper sheet handling machine of claim 10, wherein a storage that is configured to store the paper sheet is provided inside the first body, a door for exposing the inside of the first body is provided on an end on the first direction side of the first body, and the raised portion is provided on a side closer to the door than a center of the first body in the first direction.

14. A paper sheet handling machine, comprising:

a first body; and a second body provided above the first body and including a first transport that is configured to transport a paper sheet, wherein the first transport includes a first portion extending in a horizontal direction in a first direction from a rear side of the machine to a front side of the machine being opposite of the rear side of the machine, and a second portion provided below the first portion and being capable of engaging with the first portion, the first transport is in a first state in which the first transport is capable of transporting the paper sheet between the first portion and the second portion when the first portion and the second portion engage with each other, the first transport is in a second state in which the second portion is swingable in a direction away from the first portion and below the first portion by an own weight of the second portion about a first swing axis extending in a direction orthogonal to the first direction and horizontal when engagement between the first portion and the second portion is released, wherein the first body includes a facing surface that faces the second body when the second body of which the first transport is in the second state is moved in a second direction opposite to the first direction and a raised portion provided on the facing surface, and the raised portion comes into contact with the second portion of the second body, thereby engaging the second portion with the first portion, when the second body of which the first transport is in the second state is moved in the second direction, wherein the first body includes a contact portion having the raised portion, wherein the contact portion further has a corner on the first direction side of the first body, wherein the corner comes into contact with the second portion of the second body, thereby guiding movement of the second portion to the first portion, when the second body of which the first transport path is in the second state is moved in the second direction.

15. The paper sheet handling machine of claim 14, wherein the facing surface is a flat surface, and at least a portion of the raised portion that comes into contact with the second portion is formed into an arc shape.

16. The paper sheet handling machine of claim 14, wherein a first engagement portion is provided on a portion on a first direction side of the first portion, and a second engagement portion that is configured to engage with the first engagement portion is provided on a. portion on the first direction side of the second portion.

17. The paper sheet handling machine of claim 14, wherein a storage that is configured to store the paper sheet is provided inside the first body, a door for exposing the inside of the first body is provided on an end on the first direction side of the first body, and the raised portion is provided on a side closer to the door than a center of the first body in the first direction.

18. A paper sheet handling machine, comprising;

a first body; and a second body provided above the first bod and including a first transport that is configured to transport a paper sheet, wherein the first transport includes a first portion extending in a horizontal direction in a first direction from a rear side of the machine to a front side of the machine being opposite of the rear side of the machine, and a second portion provided below the first portion and being capable of engaging with the first portion, the first transport is in a first state in which the first transport is capable of transporting the paper sheet between the first portion and the second portion when the first portion and the second portion engage with each other, the first transport is in a second state in which the second portion is swingable in a direction away from the first portion and below the first portion by an own weight of the second portion about a first swing axis extending in a direction orthogonal to the first direction and horizontal when engagement between the first portion and the second portion is released, wherein the second body includes a second transport that is configured to transport the paper sheet, and the second transport includes a third portion extending in the first direction, and a fourth portion being capable of engaging with the third portion, the second transport is in a third state in which the second transport is capable of transporting the paper sheet between the third portion and the fourth portion when the third portion and the fourth portion engage with each other, and the second transport is in a fourth state in which the fourth portion is swingable with respect to the third portion about a second swing axis extending in a direction orthogonal to the first direction and horizontal when engagement between the third portion and the fourth portion is released.

* * * * *